US008210141B2

(12) United States Patent
Nakamura

(10) Patent No.: US 8,210,141 B2
(45) Date of Patent: Jul. 3, 2012

(54) VARIABLE VALVE SYSTEM OF INTERNAL COMBUSTION ENGINE

(75) Inventor: Makoto Nakamura, Isehara (JP)

(73) Assignee: Hitachi, Ltd., Tokyo (JP)

( * ) Notice: Subject to any disclaimer, the term of this patent is extended or adjusted under 35 U.S.C. 154(b) by 739 days.

(21) Appl. No.: 12/208,017

(22) Filed: Sep. 10, 2008

(65) Prior Publication Data

US 2009/0078223 A1 Mar. 26, 2009

(30) Foreign Application Priority Data

Sep. 20, 2007 (JP) ..... 2007-243243

(51) Int. Cl.
*F01L 1/34* (2006.01)

(52) U.S. Cl. ..... 123/90.15; 123/90.17; 123/347

(58) Field of Classification Search ..... 123/90.15, 123/90.17, 347, 348
See application file for complete search history.

(56) References Cited

U.S. PATENT DOCUMENTS

| | | | | |
|---|---|---|---|---|
| 6,330,869 | B1 * | 12/2001 | Yoshiki et al. | 123/90.15 |
| 6,502,537 | B2 | 1/2003 | Todo et al. | |
| 6,550,437 | B2 | 4/2003 | Nakamura et al. | |
| 6,705,257 | B2 | 3/2004 | Shimizu | |
| 6,840,235 | B2 | 1/2005 | Koseki et al. | |
| 7,159,545 | B2 | 1/2007 | Miyakoshi et al. | |
| 7,159,548 | B2 | 1/2007 | Shindou | |
| 7,168,402 | B2 | 1/2007 | Takemura et al. | |
| 7,198,012 | B2 | 4/2007 | Suga et al. | |
| 7,213,554 | B2 * | 5/2007 | Kanada et al. | 123/90.17 |
| 7,246,581 | B2 | 7/2007 | Suga et al. | |
| 7,246,594 | B2 | 7/2007 | Hartmann | |
| 7,322,324 | B2 | 1/2008 | Hara et al. | |
| 7,357,119 | B2 | 4/2008 | Yoshida et al. | |
| 7,406,935 | B2 | 8/2008 | Suga et al. | |
| 7,594,487 | B2 | 9/2009 | Okamoto | |
| 7,793,625 | B2 | 9/2010 | Nakamura et al. | |
| 7,827,949 | B2 | 11/2010 | Suga et al. | |
| 2004/0154568 | A1 | 8/2004 | Yamauchi et al. | |
| 2005/0211204 | A1 | 9/2005 | Todo et al. | |
| 2007/0163524 | A1 | 7/2007 | Muraji et al. | |

(Continued)

FOREIGN PATENT DOCUMENTS

CN 1651724 A 8/2005

(Continued)

OTHER PUBLICATIONS

Makoto Nakamura, USPTO Office Action, U.S. Appl. No. 12/213,191, Jan. 12, 2011, 6 pages.

(Continued)

*Primary Examiner* — Ching Chang
(74) *Attorney, Agent, or Firm* — Foley & Lardner LLP

(57) ABSTRACT

An intake side phase varying mechanism varies an open/close timing of an intake valve, and an exhaust side phase varying mechanism varies an open/close timing of an exhaust valve. Before starting the engine, one of the intake and exhaust side phase varying mechanisms is caused to keep a first position wherein the intake and exhaust valves show the largest valve overlap therebetween and the other of the mechanisms is caused to keep a second position wherein the intake and exhaust valves show the smallest valve overlap therebetween. A controller is configured to carry out, after starting the engine, causing the selected one of the intake and exhaust side phase varying mechanisms to be actually controlled to the first position and causing the other to be actually controlled to the second position.

14 Claims, 15 Drawing Sheets

U.S. PATENT DOCUMENTS

| | | | |
|---|---|---|---|
| 2008/0257289 | A1 | 10/2008 | Nakamura |
| 2009/0007866 | A1 | 1/2009 | Nakamura |
| 2009/0078223 | A1 | 3/2009 | Nakamura |

FOREIGN PATENT DOCUMENTS

| | | | |
|---|---|---|---|
| EP | 1 559 875 | A2 | 8/2005 |
| JP | 6-235307 | A | 8/1994 |
| JP | 10-008935 | A | 1/1998 |
| JP | 10-082334 | A | 3/1998 |
| JP | 11-93714 | A | 4/1999 |
| JP | 2002-227615 | A | 8/2002 |
| JP | 2002-256832 | A | 9/2002 |
| JP | 2003-35167 | A | 2/2003 |
| JP | 2003-172112 | A | 6/2003 |
| JP | 2004-076618 | A | 3/2004 |
| JP | 2004-156508 | A | 6/2004 |
| JP | 2004-257373 | A | 9/2004 |
| JP | 2004-346887 | A | 12/2004 |
| JP | 2005-105874 | A | 4/2005 |
| JP | 2005-226511 | A | 8/2005 |
| JP | 2005-233049 | A | 9/2005 |
| JP | 2005-264804 | A | 9/2005 |
| JP | 2006-70726 | A | 3/2006 |
| JP | 2006-138292 | A | 6/2006 |
| JP | 2006-200391 | A | 8/2006 |

OTHER PUBLICATIONS

Makoto Nakamura, USPTO Notice of Allowance, U.S. Appl. No. 12/213,191, 6 pages.

Makoto Nakamura et al., USPTO Notice of Allowance, U.S. Appl. No. 12/131,460, 8 pages.

Makoto Nakamura, USPTO Office Action, U.S. Appl. No. 12/076,172, Aug. 24, 2010, 14 pages.

Makoto Nakamura, USPTO Office Action, U.S. Appl. No. 12/076,172, Feb. 7, 2011, 14 pages.

Makoto Nakamura, USPTO Notice of Allowance, U.S. Appl. No. 12/076,172, Jul. 28, 2011, 7 pages.

* cited by examiner

VARIABLE VALVE SYSTEM OF INTERNAL COMBUSTION ENGINE

BACKGROUND OF THE INVENTION

Field of the Invention

The present invention relates in general to variable valve systems of an internal combustion engine, and more particularly to the variable valve systems of a type that exhibits a satisfied performance in exhaust emission reduction in a certain time that follows the engine starting.

One of the variable valve systems of the above-mentioned type is shown in Japanese Laid-open Patent Application (Tokkai) 2005-233049. In the variable valve system of this publication, by selectively charging and discharging timing advancing and retarding hydraulic chambers formed in a housing, a vane member connected to a camshaft is turned in one or other direction by a controlled angle, so that an open/close timing (viz., valve timing) of each intake valve is varied or controlled in accordance with an operation condition of the engine. Before stopping the engine, the vane member is controlled to take an intermediate position with a slight advance and locked at the position by a lock pin thereby to suppress a free relative rotation between the housing and the vane member. With this, a suitable valve overlap between the intake and exhaust valves is provided, which exhibits a certain reduction in exhaust emission in a certain time that follows the engine starting, particularly, in the time that follows a cold engine starting.

SUMMARY OF THE INVENTION

However, even the above-mentioned variable valve system fails to exhibit a satisfied performance in exhaust emission reduction particularly when the engine is subjected to a hard braking and/or sudden stopping. That is, since the intermediate position taken by the vane member is not mechanically stable, the lock operation for projecting the lock pin into a lock opening is not assuredly carried out under such hard condition. In this case, the vane member can't be locked at a desired advanced angular position, and thus, satisfied reduction in exhaust emission at the cold engine starting is not achieved.

In view of the above, one measure may be thought out wherein upon cold starting of the engine, a certain amount of hydraulic fluid is fed to the timing advancing hydraulic chambers to turn the vane member in a timing advancing direction for providing a certain degree of valve overlap between the intake and exhaust valves. However, in cold starting of the engine, the hydraulic fluid shows a very low temperature and thus shows a high viscosity. Due to the high viscosity of the hydraulic fluid, feeding the hydraulic fluid to the timing advancing hydraulic chambers is not instantly made, and thus, the relative rotation between the housing and the vane member is not smoothly carried out, which brings about a poor performance in reducing exhaust emission in the time that follows the engine starting.

Accordingly, it is an object of the present invention to provide a variable valve system of an internal combustion engine, which is free of the above-mentioned drawbacks.

According to the present invention, there is provided a variable valve system of an internal combustion engine, in which upon stopping of an engine, a mechanically stable valve overlap between intake and exhaust valves is provided by a cooperated work between an intake side phase varying mechanism and an exhaust side phase varying mechanism, so that subsequent starting (or re-starting) of the engine is carried out with the mechanically stable valve overlap, which brings about satisfied reduction in exhaust emission in a certain time that follows the engine starting.

In accordance with a first aspect of the present invention, there is provided a variable valve system of an internal combustion engine which comprises an intake side phase varying mechanism that varies an open/close timing of an intake valve; an exhaust side phase varying mechanism that varies an open/close timing of an exhaust valve, before starting the engine, one of the intake and exhaust side phase varying mechanisms being caused to keep a first position wherein the intake and exhaust valves show the largest valve overlap therebetween and the other of the mechanisms being caused to keep a second position wherein the intake and exhaust valves show the smallest valve overlap therebetween; and a controller that is configured to carry out, after starting the engine, causing the selected one of the intake and exhaust side phase varying mechanisms to be actually controlled to the first position and causing the other to be actually controlled to the second position.

In accordance with a second aspect of the present invention, there is provided a variable valve mechanism of an internal combustion engine, which comprises an intake side phase varying mechanism that varies an open/close timing of an intake valve; and an exhaust side phase varying mechanism that varies an open/close timing of an exhaust valve, before starting the engine, one of the intake and exhaust side phase varying mechanisms being caused to keep a first position wherein the intake and exhaust valves show the largest valve overlap therebetween and the other of the mechanisms being caused to keep a second position wherein the intake and exhaust valves show the smallest valve overlap therebetween.

In accordance with a third aspect of the present invention, there is provided a phase varying mechanism for varying an open/close timing of an exhaust valve of an internal combustion engine, which comprises a device that causes the open/close timing of the exhaust valve to take the most retarded timing before starting the engine.

In accordance with a fourth aspect of the present invention, there is provided a method of controlling a variable valve system of an internal combustion engine, the variable valve system including an intake side phase varying mechanism that varies an open/close timing of an intake valve and an exhaust side phase varying mechanism that varies an open/close timing of an exhaust valve, the method comprising, before starting the engine, causing one of the intake and exhaust side phase varying mechanisms to keep a first position wherein the intake and exhaust valves show the largest valve overlap therebetween and causing the other to keep a second position wherein the intake and exhaust valves show the smallest valve overlap therebetween; and after starting the engine, causing the selected one of the intake and exhaust side phase varying mechanisms to be actually controlled to the first position and causing the other to be actually controlled to the second position.

BRIEF DESCRIPTION OF THE DRAWINGS

Other objects and advantages of the present invention will become apparent from the following description when taken in conjunction with the accompanying drawings, in which.

DETAILED DESCRIPTION OF EMBODIMENTS

In the following, two embodiments 100 and 200 of the present invention will be described in detail with reference to the accompanying drawings.

First embodiment 100 is shown in FIGS. 1 to 9 and second embodiment 200 is shown in FIGS. 1 and 10 to 17.

For ease of understanding, various directional terms, such as, right, left, upper, lower, rightward and the like are used in the following description. However, such terms are to be understood with respect to only a drawing or drawings on which a corresponding portion or part is shown.

As will become clear as the description proceeds, the variable valve system of the present invention is applied to a four-cycle internal combustion engine operated on gasoline.

Figure 1:
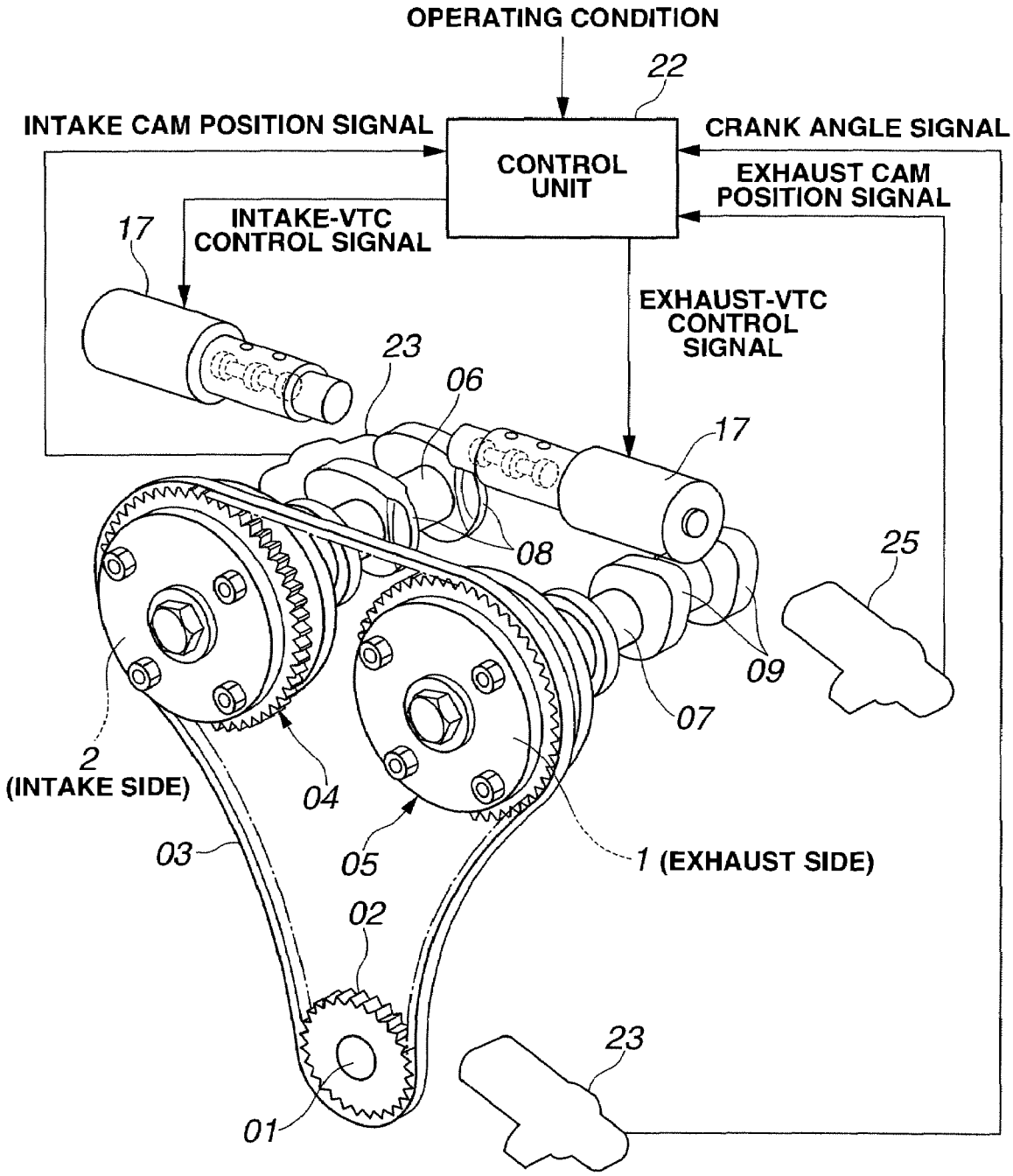
FIG. 1 is a perspective view of some elements of an internal combustion engine, which are incorporated with a variable valve system of the present invention.

Referring to FIG. 1, there are shown essential elements of the internal combustion engine, which constitute a variable valve system of the present invention.

As shown in the drawing, the variable valve system comprises generally intake and exhaust side timing pulleys 04 and 05 to which a torque of a crankshaft 01 is transmitted through a drive pulley 02 and a timing chain 03, intake and exhaust side cam shafts 06 and 07 to which toques of timing pulleys 04 and 05 are respectively transmitted, two intake side cams 08 and 08 that are mounted on intake side cam shaft 06 for opening respective intake valves (not shown) against the force of biasing springs (not shown) and two exhaust side cams 09 and 09 that are mounted on exhaust side cam shaft 07 for opening respective exhaust valves (not shown) against the force of biasing springs (not shown). Although not shown in the drawing, the two intake valves and two exhaust valves are possessed by each cylinder of the engine.

As is seen from FIG. 1, between exhaust side timing pulley 05 and exhaust side cam shaft 07, there is arranged an exhaust side phase varying mechanism (viz., exhaust-VTC) 1 for controlling open/close timing of the exhaust valves in accordance with an operation condition of the engine, and between intake side timing pulley 04 and intake side cam shaft 06, there is arranged an intake side phase varying mechanism (viz., intake-VTC) 2 for controlling open/close timing of the intake valves in accordance with the operation condition of the engine.

Exhaust and intake side phase varying mechanisms (viz., exhaust-VTC and intake-VTC) 1 and 2 are of a vane type and have generally the same construction.

Figure 2:
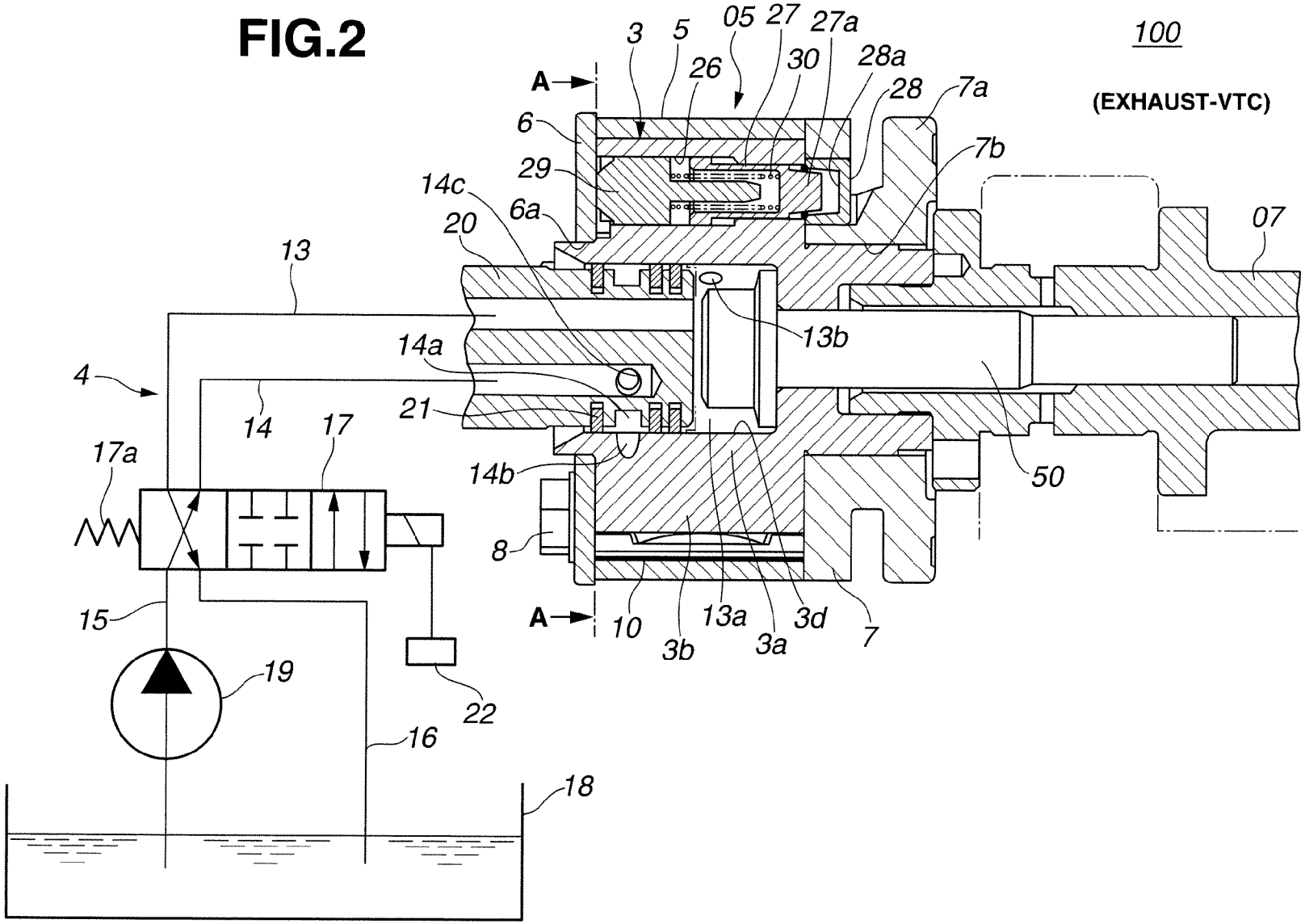
FIG. 2 is a sectional view of an exhaust side phase varying mechanism employed in a variable valve system of a first embodiment of the present invention.
Figure 3:
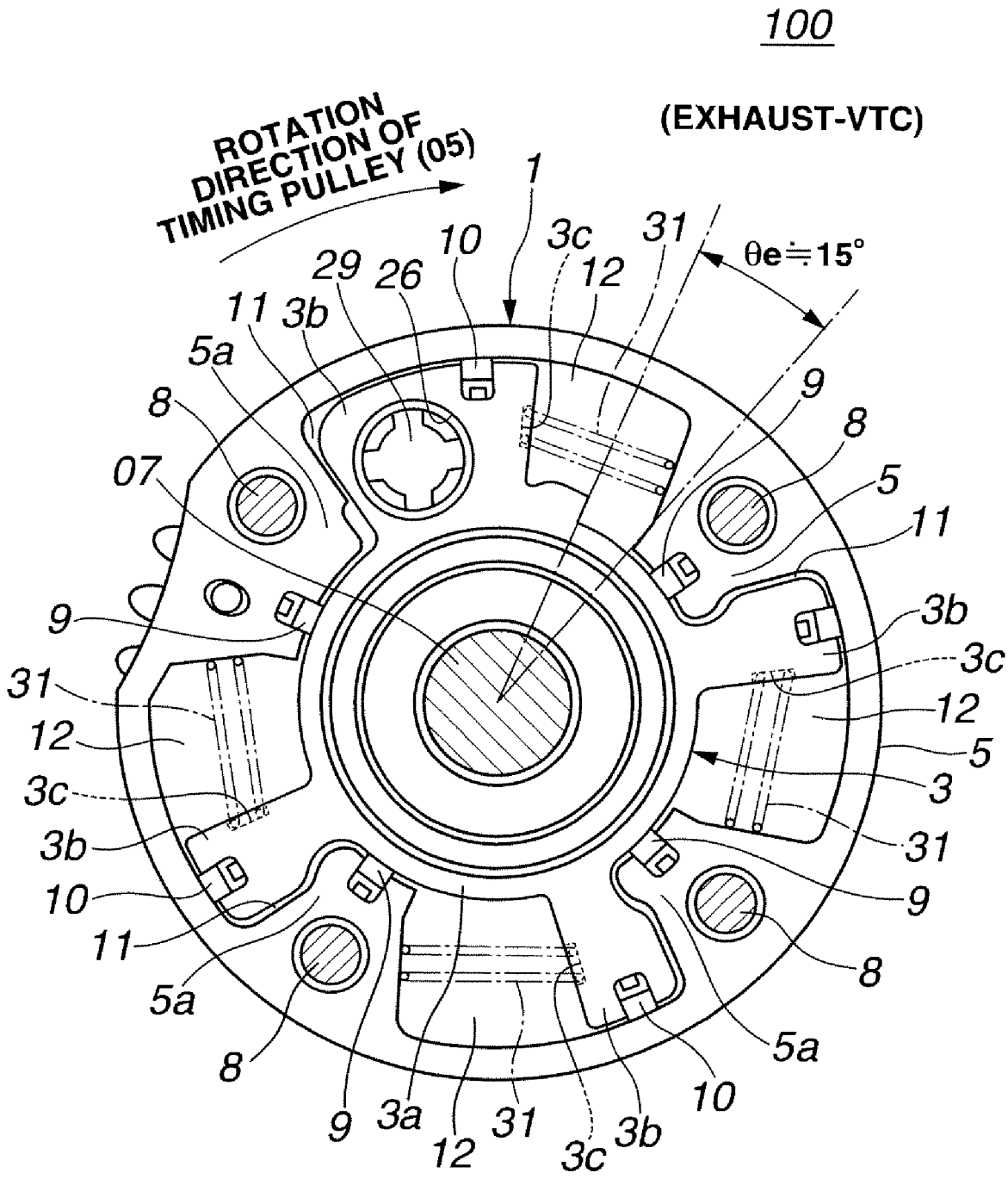
FIG. 3 is a sectional view taken along the line A-A of FIG. 2, showing the most retarded timing position of the exhaust side phase varying mechanism employed in the variable valve system of the first embodiment.

As is seen from FIGS. 2 and 3, exhaust side phase varying mechanism (exhaust-VTC) 1 comprises timing pulley 05 that transmits a torque to exhaust side cam shaft 07, a vane member 3 that is fixed to an end of exhaust side cam shaft 07 and rotatably received in timing pulley 05, and a hydraulic circuit 4 that turns vane member 3 in one or other direction with the aid of hydraulic power.

As is seen from FIG. 2, timing pulley 05 comprises a cylindrical housing 5 that has vane member 3 rotatably received therein, a circular front cover 6 that covers a front (or left) open end of housing 5, and a generally circular rear cover 7 that covers a rear (or right) open end of housing 5.

As is seen from FIGS. 1, 2 and 3, cylindrical housing 5, front cover 6 and rear cover 7 are united together by means of four connecting bolts 8 that extend in parallel with exhaust side cam shaft 07.

As is seen from FIG. 3, cylindrical housing 5 is formed at every 90-degree intervals of an internal surface thereof with four shoes (viz., partition walls) **5*a* that project radially inward. As shown, each shoe 5*a* has a generally trapezoidal cross section when cut laterally and has at generally middle part a bolt opening (no numeral) through which the corresponding connecting bolt 8** passes.

Furthermore, as is understood from FIG. 3, each shoe **5*a* is formed at an inwardly projected part thereof with an axially extending holding groove (no numeral) in which an elongate seal member 9 is operatively held. Seal member 9 has a generally U-shaped cross section. Although not shown in the drawing, a leaf spring is received in each holding groove for biasing seal member 9 radially inward, that is, toward the cylindrical outer surface of annular vane rotor part 3*a* of vane member 3**.

As is seen from FIG. 2, circular front cover 6 is formed at a center part thereof with a larger holding opening 6*a* and at a peripheral part thereof with equally spaced four bolt openings (not shown) that are respectively aligned or merged with the above-mentioned four bolts openings of cylindrical housing 5.

As is seen from FIG. 2, circular rear cover 7 is formed at a rear (or right) end part thereof with a gear 7*a* around which the above-mentioned timing chain 03 (see FIG. 1) is operatively put. Furthermore, circular rear cover 7 is formed at a center part thereof with a shaft receiving through bore 7*b*.

As is seen from FIG. 3, vane member 3 comprises an annular vane rotor part 3*a* that has a center bolt opening (no numeral), and four vanes 3*b* that project radially outward from annular vane rotor part 3*a* at every 90-degree intervals.

As is seen from FIG. 2, a front smaller diameter portion of annular vane rotor part 3*a* is rotatably received in holding opening 6*a* of circular front cover 6, and a rear smaller diameter portion of annular vane rotor part 3*a* is rotatably received in through bore 7*b* of circular rear cover 7.

As shown in FIG. 2, vane member 3 is fixed to a front (or left) end of exhaust side cam shaft 07 by means of a connecting bolt 50 that passes through the bolt opening of vane rotor part 3*a*. Thus, vane member 3 and exhaust side cam shaft 07 rotate like a single unit.

As is seen from FIG. 3, among the four vanes 3*b* of vane member 3, three of them are relatively small in size and rectangular in shape and the other one is relatively large in size and trapezoidal in shape. That is, all of the smaller three vanes 3*b* are substantially the same in shape and size, and the other larger vane 3*b* is larger than the other three smaller vanes 3*b*. Four vanes 3*b* are so sized and arranged as to allow the entire construction of vane member 3 to have a weight-balanced structure.

As shown, each vane 3*b* is placed between adjacent two shoes 5*a* of cylindrical housing 5, and each vane 3*b* is formed at an outwardly projected part thereof with an axially extending holding groove (no numeral) in which an elongate seal member 10 is operatively held. Seal member 10 has a generally U-shaped cross section. Although not shown in the drawing, a leaf spring is received in each holding groove for biasing seal member 10 radially outward, that is, toward the cylindrical inner surface of cylindrical housing 5.

Furthermore, as is seen from FIG. 3, a leading (or right) side of each vane 3*b*, with respect to the direction of rotation of exhaust side cam shaft 07, is formed with two circular recesses 3*c*.

Due to provision of the four vanes 3*b* and the four shoes 5*a* that are arranged in the above-mentioned manner, four advancing hydraulic chambers 11 and four retarding hydraulic chambers 12 are defined at both sides of the vanes 3*b*.

As is seen from FIG. 2, hydraulic circuit 4 comprises a first hydraulic passage 13 that is connected to advancing hydraulic chambers 11, a second hydraulic passage 14 that is connected to retarding hydraulic chambers 12 and an electromagnetic switch valve 17 that controls or switches a connection between each of hydraulic passages 13 and 14 and each of an oil pump 19 and a drain passage 16. As shown, oil pump 19 is connected to switch valve 17 through a feeding passage 15. That is, oil pump 19 sucks oil from an oil pan 18 to which oil is returned through drain passage 16. Switching action of switch valve 17 is controlled by a control unit 22 that will be described in detail hereinafter.

As is seen from FIG. 2, first and second hydraulic passages 13 and 14 are formed in a cylindrical rod member 20. As shown, this rod member 20 has a right end portion received in annular vane rotor part 3*a* of vane member 3 and held in a supporting bore end portion 3*d* defined in annular vane rotor part 3*a*. Rod member 20 has a left end portion from which first and second hydraulic passages 13 and 14 are led to electromagnetic switch valve 17.

Between a cylindrical outer surface of the right end portion of rod member 20 and a cylindrical inner surface of supporting bore end portion 3*d*, there are operatively arranged three annular seal members 21 that are held by the rod member 20.

First hydraulic passage 13 is connected to a work chamber 13*a* that is defined by the above-mentioned supporting bore end portion 3*d* and closed by the right end of rod member 20. Work chamber 13*a* is connected to four advancing hydraulic chambers 11 through four branch passages 13*b* that are radially provided in vane rotor part 3*a* of vane member 3 at evenly spaced intervals.

While, second hydraulic passage 14 has its terminal right end in rod member 20, as shown. Second hydraulic passage 14 is connected to an annular groove 14*a* formed around the cylindrical right end portion of rod member 20. For this connection, a branch passage 14*c* is formed in rod member 20. Annular groove 14*a* is connected to four retarding hydraulic chambers 12 through respective second passages 14*b* formed in annular vane rotor part 3*a* of vane member 3. Each second passage 14*b* is generally L-shaped.

Electromagnetic switch valve 17 is of a four port three position type, whose valve element moves to change a fluid connection between each of hydraulic passages 13 and 14 and each of feeding passage 15 and drain passage 16. Such movement of valve element is controlled by the control unit 22. By means of a biasing spring 17*a*, the valve element is biased to move in a given direction.

Due to the switching operation of switch valve 17, retarding hydraulic chambers 12 are fed with a hydraulic fluid upon engine starting, and thereafter, advancing hydraulic chambers 11 are fed with the hydraulic fluid.

Between vane member 3 and cylindrical housing 5, there is arranged a lock mechanism that is capable of locking vane member 3 relative to cylindrical housing 5.

That is, as is seen from FIGS. 2 and 3, the lock mechanism is arranged between the larger vane 3*b* of vane member 3 and the above-mentioned circular rear cover 7 that has a thicker structure, and comprises an axially extending bore 26 formed in the larger vane 3*b*, a cylindrical lock pin 27 slidably received in bore 26 and a cup-shaped catch member 28 fixed in a hole formed in rear cover 7. Cup-shaped catch member 28 is formed with a tapered bore 28*a* that is sized to operatively receive a tapered head 27*a* of lock pin 27. A coil spring 30 is compressed between a spring retainer 29 fixed in the bore 26 and lock pin 27, so that the lock pin 27 is biased in a direction to establish the locked engagement between lock pin 27 and catch member 28. As shown, due to the mutual engagement between tapered head 27*a* of lock pin 27 and tapered bore 28*a* of catch member 28, the tapered bore 28*a* serves as a work chamber. Although not shown in the drawings, there is provided a hydraulic passage through which the work chamber 28*a* is connected with one of retarding hydraulic chambers 12.

That is, when vane member 3 is turned to the most retarded timing position (viz., first position), lock pin 27 (more specifically, the tapered head 27*a*) is brought into tapered bore 28*a* due to the biasing force of coil spring 30. Upon this, as is seen from FIG. 1, timing pulley 05 and exhaust side cam shaft 07 are tightly coupled. That is, relative rotation therebetween is blocked. While, when a certain amount of hydraulic fluid is fed to tapered bore 28*a* from the retarding hydraulic chamber 12, lock pin 27 is moved back from tapered bore 28*a*. Upon this, the tight coupling between timing pulley 05 and exhaust side cam shaft 07 is released.

As is seen from FIG. 3, in each retarding hydraulic chamber 12, there are arranged a pair of coil springs 31 that are compressed between vane 3*b* of vane member 3 and shoe 5*a* of cylindrical housing 5. With such coil springs 31, vane member 3 is biased to rotate in a counterclockwise direction in FIG. 3 relative to housing 5, that is, in a timing retarding direction.

These two coil springs 31 in each retarding hydraulic chamber 12 are independently provided and arranged to extend in parallel with each other. These two coil springs 31 have the same length and are sized to produce a certain biasing force even when vane member 3 assumes the most retarded timing position as shown in FIG. 3.

These two coil springs 31 are sufficiently spaced apart from each another, so that even when compressed maximally, these coil springs 31 show no mechanical contact therebetween. Each coil spring 31 has one end fixed to a retainer (not shown) that is tightly put in the above-mentioned circular recess 3*c* of each vane 3*b*.

Figure 4:
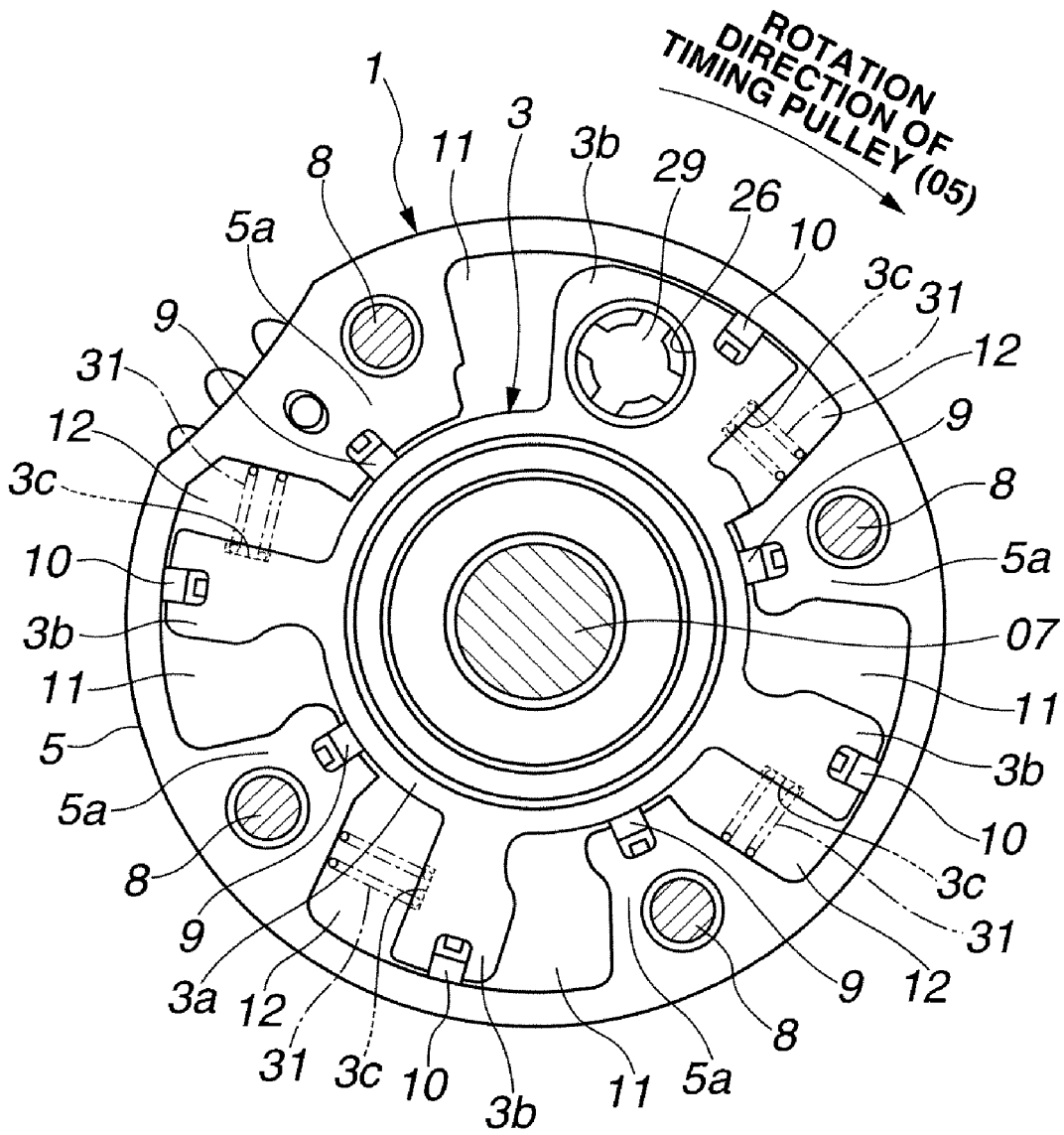
FIG. 4 is a view similar to FIG. 3, but showing the most advanced timing position of the exhaust side phase varying mechanism.

It is to be noted that FIG. 3 shows the most retarded timing position of vane member 3 and FIG. 4 shows the most advanced timing position of vane member 3.

In the first embodiment 100 of the present invention, a variable angle "Θe" of vane member 3 in the exhaust side, that is, to a difference between the most retarded timing position of FIG. 3 and the most advanced timing position of FIG. 4, is controlled to about 15 degrees.

Figure 5:
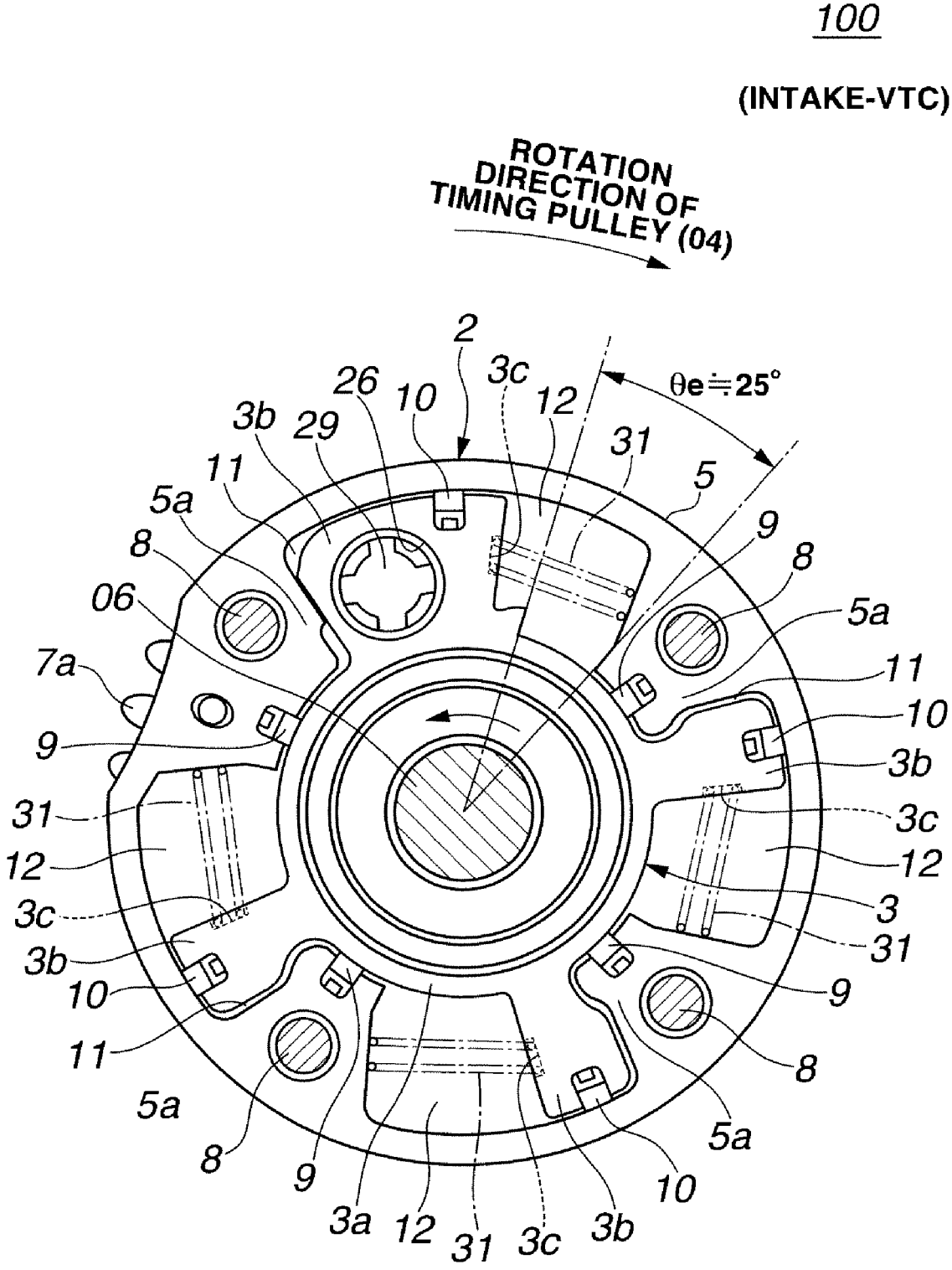
FIG. 5 is a sectional view of an intake side phase varying mechanism employed in the variable valve system of the first embodiment of the present invention, showing the most retarded timing position of the intake side phase varying mechanism.

As is seen from FIG. 5, intake side phase varying mechanism (viz., intake-VTC) 2 is substantially the same in construction as the above-mentioned exhaust side phase varying mechanism (viz., exhaust-VTC) 1. Thus, substantially the same elements as the above-mentioned elements are denoted by the same numerals and detailed explanation of them will be omitted from the following description.

It is however to be noted that in case of intake side phase varying mechanism 2, a variable angle "Θi" of vane member 3, that is, the difference between the most retarded timing position of vane member 3 shown in FIG. 5 and the most advanced timing position of vane member 3 (not shown), is controlled to about 25 degrees.

In the following, operation of exhaust side phase varying mechanism (exhaust-VTC) 1 will be described with the aid of the accompanying drawings, particularly FIG. 2.

For ease of understanding, the description will be commenced with respect to a condition wherein the vehicle is under idling condition. Under such condition, vane member 3 of the mechanism 1 assumes a position other than the most retarded and advanced timing positions, and electromagnetic switch valve 17 assumes a condition wherein feeding passage 15 is communicated with first hydraulic passage 13 and drain passage 16 is communicated with second hydraulic passage 14.

When now an ignition key is turned off, control current from control unit 22 to electromagnetic switch valve 17 stops and thus with the force of biasing spring 17*a*, the valve element of the switch valve 17 is moved to the position as shown in FIG. 2. Thus, feeding passage 15 becomes communicated with second hydraulic passage 14. However, due to stopping of the engine, the hydraulic pressure produced by oil pump 19 becomes 0 (zero). Thus, the hydraulic pressure supplied to four retarding hydraulic chambers 12 through second hydraulic passage 14 is 0 (zero), which fails to produce a force to turn vane member 3 in the timing retarding direction.

However, as will be understood from FIG. 3, even in such condition, due to friction of the valve mechanism caused by alternating torque applied to exhaust side cam shaft 07 and the biasing force of coil springs 31, vane member 3 is forced to turn in the timing retarding direction relative to timing pulley 05, that is, in a direction opposite to the rotation direction of exhaust side cam shaft 07, that is, in a counterclockwise direction in FIG. 3, and finally take a stable position.

In this stable position, vane member 3 assumes the most retarded timing position (viz., first position) wherein as is shown in FIG. 3 a left side of the larger vane 3*b* of vane member 3 is in contact with a right side of the left-positioned shoe 5*a* minimizing the volume of the corresponding advancing hydraulic chamber 11.

Under this condition, the phase of exhaust side cam shaft 07 relative to exhaust side timing pulley 05 (or crankshaft of the engine) is controlled to the most retarded side.

Upon this, lock pin 27 is thrust into tapered bore 28*a* of catch member 28 (see FIG. 2) due to the force of coil spring 30. That is, when vane member 3 comes to the most retarded timing position (viz., first position), lock pin 27 held by vane member 3 becomes aligned with tapered bore 28*a*. Thus, due to the locked engagement between vane member 3 and tapered bore 28*a*, relative rotation between exhaust side timing pulley 05 and exhaust side cam shaft 07 is suppressed and thus the most retarded timing position of exhaust side cam shaft 07 is assuredly established.

Accordingly, even under cranking of the engine which tends to produce a marked fluctuation of engine rotation, the most retarded timing position (viz., first position) of exhaust side cam shaft 07 is stably kept. Due to the locked engagement between vane member 3 and exhaust side cam shaft 07 by lock pin 27, undesired vibration of vane member 3 and that of exhaust side cam shaft 07 are sufficiently suppressed. Accordingly, the valve timing control is stably carried out. That is, improved starting of the engine and reduction in exhaust emission in a time that follows the cold engine starting are assuredly obtained.

In the following, operation of intake side phase varying mechanism (viz., intake-VTC) 2 will be described with the aid of FIG. 5.

Like the above-mentioned exhaust side phase varying mechanism (viz., exhaust-VTC) 1, due to friction of the valve mechanism caused by alternating torque applied to intake side cam shaft 06 (see FIG. 1) and the biasing force of coil springs 31, vane member 3 is forced to turn in the timing retarding direction relative to timing pulley 04, that is, in a direction opposite to the rotation direction of intake side cam shaft 06, that is, in a counterclockwise direction in FIG. 5, and finally take a stable position.

In this stable position, vane member 3 of intake side phase varying mechanism (viz., intake-VTC) 2 assumes the most retarded timing position (viz., second position) wherein as is shown in FIG. 5 a left side of the larger vane 3*b* of vane member 3 is in contact with a right side of the left-positioned shoe 5*a* minimizing the volume of the corresponding advancing hydraulic chamber 11.

Under this condition, the phase of intake side cam shaft 06 relative to intake side timing pulley 04 (or crankshaft of the engine) is controlled to the most retarded timing side.

Upon this, for the same reasons as is mentioned hereinabove, lock pin 27 is thrust into tapered bore 28*a* of catch member 28 due to the force of the coil spring 30. Thus, relative rotation between intake side timing pulley 04 and intake side cam shaft 06 is suppressed thereby assuredly establishing the most retarded timing position of intake side cam shaft 06.

With this, the open timing (viz., IVO) of the intake valves under intake stroke of the piston is controlled to the most retarded timing that is in the vicinity of the top dead center (viz., TDC).

Figure 6:
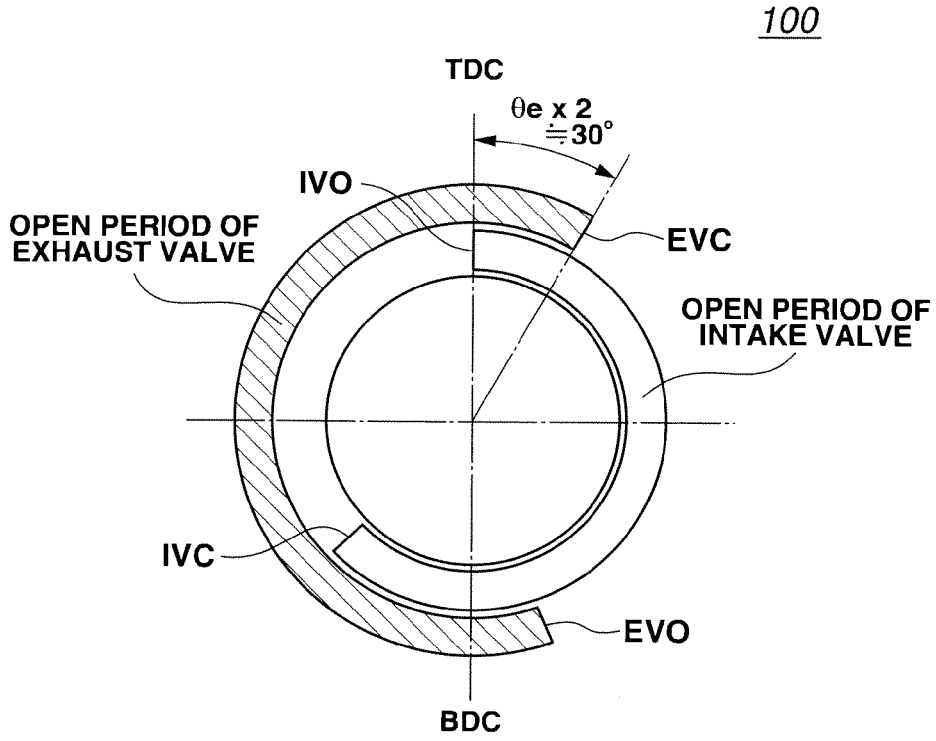
FIG. 6 is a characteristic diagram showing respective open periods of intake and exhaust valves at a time when an internal combustion engine stops or just starts.

As is seen from FIG. 6, the close timing (viz., EVC) of the exhaust valves under exhaust stroke is controlled to a timing that is retarded by "Θe×2" in crank angle, that is, for example, a timing that is retarded by about 30 degrees relative to TDC.

Accordingly, as is seen from FIG. 6, the valve overlap between the intake and exhaust valves becomes a suitable degree that is about 30 degrees.

When, with the above-mentioned suitable valve overlap kept between the intake and exhaust valves, the engine is subjected to a cold starting, the following advantageous actions are expected.

That is, residual gases are led back to the intake system of the engine to re-burn the unburned HC gases, and the heated residual gases warm the intake system to promote atomization of fuel thereby sufficiently suppressing generation of HC gases.

If the valve overlap takes an excessive degree, the amount of inert gases (viz., residual gases) in the combustion chamber is increased remarkably. In this case, a desired torque is not produced by the engine, which induces instability of engine operation. However, the suitable overlap degree, viz., 30 degrees of valve overlap, not only avoids the instability of engine operation but also induces reduction in exhaust emission in a certain time that follows the cold engine starting.

As is understood from FIG. 1, when the engine is started, control unit 22 feeds the respective electromagnetic switch valves 17 and 17 with respective control currents (or control signals). In this case, the following operation is carried out in both exhaust and intake side phase varying mechanisms (viz., exhaust-VTC and intake-VTC) 1 and 2.

That is, upon starting the engine with the above-mentioned suitable valve overlap, the pressurized hydraulic fluid from oil pump 19 (see FIG. 2) is led to respective retarding hydraulic chambers 12 and 12 of the two mechanisms (viz., exhaust-VTC and intake-VTC) 1 and 2, so that each vane member 3 is applied with a force in the timing retarding direction. In an initial stage of the engine operation, due to the locked engagement between vane member 3 and tapered bore 28*a* of catch member 28 by lock pin 27, the most retarded timing position of exhaust side cam shaft 07 and that of intake side cam shaft 06 are kept unchanged.

However, as the pressure in the respective retarding hydraulic chambers 12 and 12 increases, the hydraulic pressure in tapered bore (or work chamber) 28*a* of each mechanism (exhaust-VTC or intake-VTC) 1 or 2 increases because of the fluid communication therebetween. Accordingly, when the hydraulic pressure in tapered bore 28*a* is increased to a certain level, lock pin 27 is disengaged from tapered bore 28*a* against the force of coil spring 30. Upon this, vane member 3 in each mechanism 1 or 2 is permitted to make a rotational movement relative to exhaust or intake side cam shaft 07 or 06.

Then, the following operation is carried out in both mechanisms (viz., exhaust-VTC and intake-VTC) 1 and 2.

That is, in intake side phase varying mechanism (viz., intake-VTC) 2, the same control current from control unit 22 is continuously fed to electromagnetic switch valve 17 thereby to continuously feed the four retarding hydraulic chambers 12 of the mechanism 2 with the hydraulic fluid. Accordingly, due to the force coil springs 31 and the pressure possessed by the hydraulic fluid in the work chambers 12, vane member 3 of the mechanism 2 keeps the most retarded timing position. Accordingly, the open/close timing of the intake valves is kept unchanged and as is seen from FIG. 7, the open timing (viz., IVO) of the intake valves is controlled to or near the top dead center (viz., TDC) and the close timing (viz., IVC) of the intake valves is controlled to or near a timing position that is sufficiently retarded relative to the bottom dead center (viz., BDC).

While, in exhaust side phase varying mechanism (viz., exhaust-VTC) 1, a different control current is fed from control unit 22 to the electromagnetic switch valve 17 to feed the four retarding hydraulic chambers 12 of the mechanism 1 with the hydraulic fluid from oil pump 19. Thus, the vane member 3 is turned to the most retarded timing position. Accordingly, as is seen from FIG. 6, the close timing (viz., EVC) of the exhaust valves is controlled to a timing that is retarded by about 30 degrees with respect to the top dead center (viz., TDC). Accordingly, the above-mentioned reduction in exhaust emission is kept.

Figure 7:
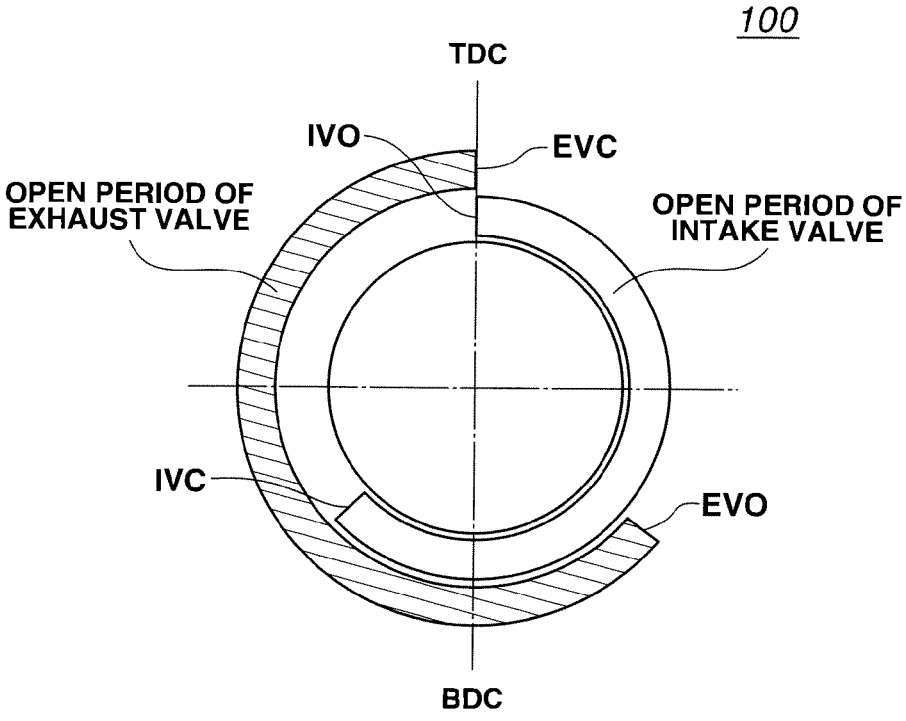
FIG. 7 is a characteristic diagram showing respective open periods of the intake and exhaust valves at a time when the engine runs at idle after completion of warming-up operation.

When warming-up of the engine advances, low load operation of the engine shows such a control of intake and exhaust valves as shown by FIG. 7. Of course, under this control, respective lock pins 27 of the two mechanisms 1 and 2 are kept disengaged from tapered bores 28*a* permitting the relative rotation between vane member 3 and exhaust side cam shaft 07 and the relative rotation between vane member 3 and intake side cam shaft 06. Due to work of control unit 22, exhaust side phase varying mechanism (viz., exhaust-VTC) 1 is controlled to a much advanced timing side as compared with intake side phase varying mechanism (viz., intake-VTC) 2, and thus the valve overlap between the intake and exhaust valves becomes substantially 0 (zero). In this condition, the amount of residual gases is small and thus desired combustion of fuel is obtained, which induces a stable operation of the engine as well as a satisfied reduction in exhaust emission.

When then the engine is shifted to an intermediate load range or low speed high load range, control unit 22 feeds respective switch valves 17 and 17 of exhaust and intake side phase varying mechanisms (viz., exhaust-VTC and intake-VTC) 1 and 2 with given switching signals. Upon this, electromagnetic switch valve 17 of exhaust side phase varying mechanism (viz., exhaust-VTC) 1 is de-energized, so that feeding passage 15 and second hydraulic passage 14 become communicated and at the same time first hydraulic passage 13 and drain passage 16 become communicated. At the same time, electromagnetic switch valve 17 of intake side phase varying mechanism (viz., intake-VTC) 2 is energized, so that feeding passage 15 and first hydraulic passage 13 become communicated and second hydraulic passage 14 and drain passage 16 become communicated.

Accordingly, in exhaust side phase varying mechanism (viz., exhaust-VTC) 1, the four retarding hydraulic chambers 12 are fed with the pressurized hydraulic fluid, and thus, vane member 3 of the mechanism 1 is turned toward the most retarded timing position. While, in intake side phase varying mechanism (viz., intake-VTC) 2, the four advancing hydraulic chambers 11 are fed with the pressurized hydraulic fluid, and thus, the vane member 3 is turned toward the most advanced timing position.

Figure 8:
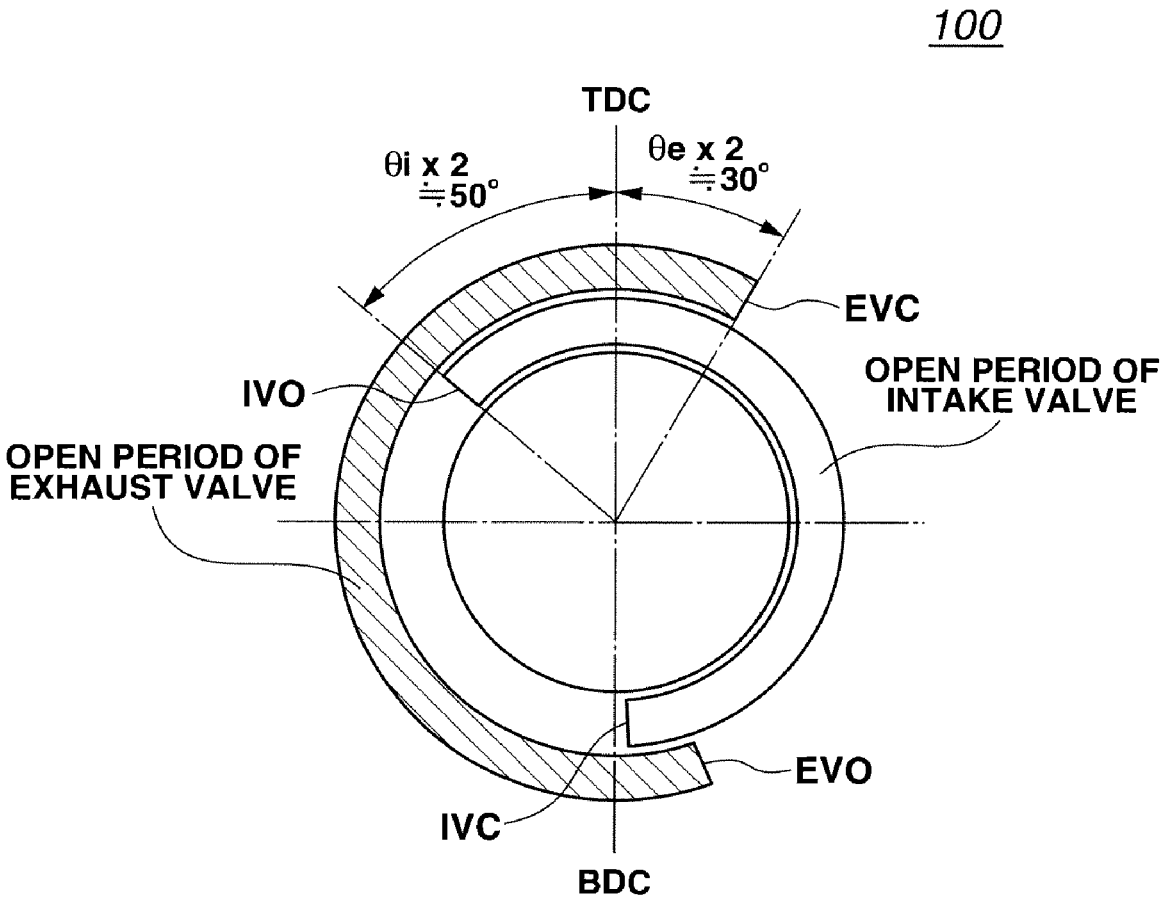
FIG. 8 is a characteristic diagram showing respective open periods of the intake and exhaust valves at a time when the engine is under intermediate load.

Accordingly, the exhaust and intake valves are forded to show such an open/close timing as shown by FIG. 8. As is seen from this drawing, the close timing (viz., EVC) of the exhaust valves is controlled to a timing that is retarded by about 30 degrees with respect to TDC, and the open timing (viz., IVO) of the intake valves is controlled to a timing that is advanced by about 50 degrees with respect to TDC.

Thus, the degree of valve overlap between the intake and exhaust valves becomes about 80 degrees (viz., 30 degrees+50 degrees), and thus, pumping loss is reduced improving the fuel consumption. That is, since, in the intermediate load range, the torque produced by fuel combustion is increased, instability of engine operation that tends to be induced under low load operation range is eliminated or at least minimized, and thus the degree of valve overlap between the intake and exhaust valves can be increased, which improves the fuel consumption of the engine.

It is to be noted that, in the intermediate load range of the engine, to cause exhaust side phase varying mechanism (exhaust-VTC) 1 to take the most retarded timing position and to cause intake side shape varying mechanism (intake-VTC) 2 to take the most advanced timing position are not always necessary.

Figure 9:
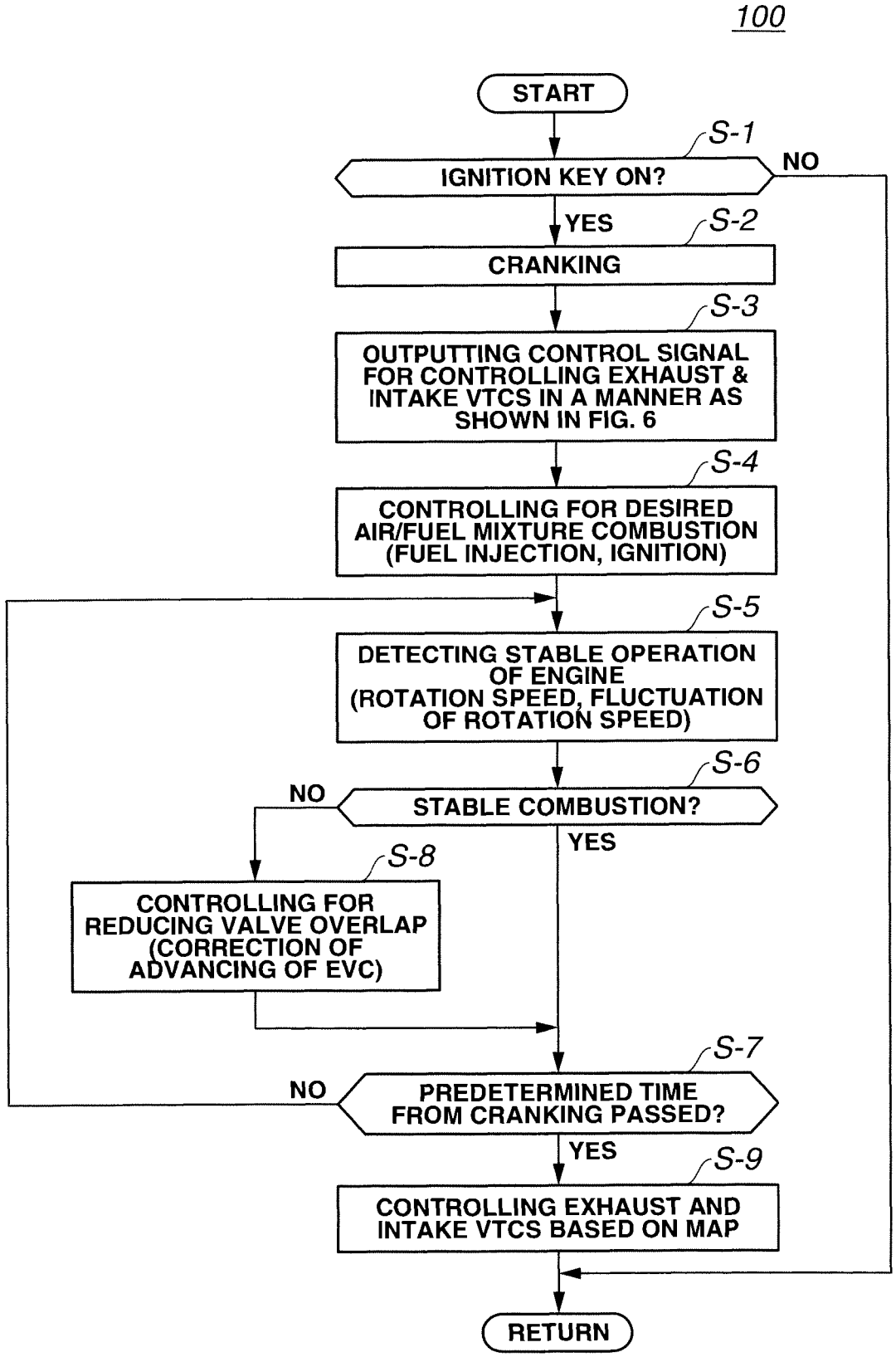
FIG. 9 is a flowchart showing programmed operation steps executed by a control unit employed in the variable valve system of the first embodiment of the invention.

In the following, programmed operation steps executed by control unit 22 at the time of cold engine starting will be described with reference to the flowchart of FIG. 9.

At step S-1, judgment is carried out as to whether an ignition key has been turned ON or not, that is, whether the engine has been started or not. If NO, the operation flow goes back to RETURN. If YES, that is, if it is judged that the ignition key has been turned ON, the operation flow goes to step S-2. At this step S-2, cranking of the engine is recognized. Before the cranking, by the function lock pin 27, vane member 3 of each phase varying mechanism 1 or 2 is fixed to exhaust (or intake) side cam shaft 07 or 06.

At step S-3, control signals are fed from control unit 22 to electromagnetic switch valves 17 and 17 of exhaust and intake side phase varying mechanisms (exhaust-VTC and intake-VTC) 1 and 2 to cause these two mechanisms 1 and 2 to show such an open/close timing as that shown by FIG. 6. That is, the retarding hydraulic chambers 12 of each phase varying mechanism 1 or 2 are fed with a pressurized hydraulic fluid. Because of increase of hydraulic pressure in tapered bore 28*a* of each mechanism 1 or 2 due to the fluid connection between tapered bore 28*a* and one of the hydraulic chambers 12, lock pin 27 of each mechanism 1 or 2 is moved to the released or disengaged position thereby permitting the relative but limited rotation between vane member 3 and exhaust (or intake) side cam shaft 07 or 06. Of course, even after disengagement of lock pin 27, the open/close timing of the exhaust and intake valves is kept controlled to such a manner as is shown by FIG. 6.

At step S-4, a fuel injection valve and an ignition plug are controlled by control signals fed from control unit 22, so that a combustion chamber has a desired air/fuel mixture combustion therein. During this, the open/close timing of the exhaust and intake valves is controlled in the manner as shown by FIG. 6. Thus, the above-mentioned reduction in exhaust emission in the time that follows the cold engine starting is obtained.

At step S-5, by processing an information signal from a crank angle sensor, an operation condition of the engine is detected.

Then, at step S-6, judgment is carried out as to whether the operation condition of the engine is stable or not. If YES, that is, if it is judged that the engine operation condition is stable, the operation flow goes to step S-7. While, if NO, that is, if it is judged that the operation condition is not stable, the operation flow goes to step S-8.

At step S-8, the four advancing hydraulic chambers 11 of exhaust side phase varying mechanism (viz., exhaust-VTC) 1 are fed with the pressurized hydraulic fluid, so that the close timing (EVC) of the exhaust valves is advanced thereby to reduce the degree of valve overlap with the intake valves. With this, combustion in each combustion chamber becomes stable. As is known, instability of engine operation is caused by increase of a valve overlap period due to reduction in valve clearance and/or increase of residual gases to the same overlap degree due to increase of gas flow resistance of the exhaust system. However, this instability of engine operation is solved by the above-mentioned valve overlap reduction method. That is, by such method, undesired increase of residual gases is suppressed.

At step S-7, judgment is carried out as to whether or not a predetermined time has passed from the time of engine cranking or not. If NO, that is, if it is judged that the predetermined time has not passed, the operation flow goes back to step S-5. While, if YES, that is, if it is judged that the predetermined time has passed, the operation flow goes to step S-9 judging that the cold engine starting control has been finished. It is to be noted that the predetermined time can be varied in accordance with the temperature and humidity of the day on which the engine operates and the temperature of the engine.

At step S-9, exhaust and intake side phase varying mechanisms 1 and 2 are controlled with reference to a given control map. That is, warming-up operation of the engine and normal operation after the warming-up operation of the engine are carried out based on instructions given by the control map. That is, in the normal operation, the control is so made as to reduce undesired pumping loss by providing the intake and exhaust valves with a larger valve overlap such as one as shown by FIG. 8, which improves a fuel consumption. Furthermore, in an idle operation after completion of the warming-up operation, the control is so made as to provide the intake and exhaust valves with a smaller valve overlap such as one as shown by FIG. 7, which improves the rotational stability (or operation stability) of the engine.

In case of the valve overlap shown by FIG. 6 wherein a mechanically stable is taken by the vane member 3, the variable angle "Θ e" (=about 15 degrees) of vane member 3 for the most retarded timing of the exhaust valves, which is given by exhaust side phase varying mechanism (exhaust-VTC) 1, is smaller than the variable angle "Θ i" (=about 25 degrees) of vane member 3 for the most retarded timing of the intake valves, which is given by intake side phase varying mechanism (intake-VTC) 2. That is, in such case, the valve overlap is relatively small. Accordingly, exhaust emission in the time that follows the engine starting is reduced. Furthermore, even when the engine is subjected to a trouble of electric system, a fail safe system used therein can function to provide the engine under warming-up with a certain rotational stability (or operation stability).

In a certain time that follows the engine starting, a mechanically stable valve timing is provided as has been mentioned hereinabove. In addition to this, due to function of each lock pin 27, each vane member 3 is assuredly locked to exhaust or intake side cam shaft 07 or 06. Accordingly, even if the cranking of the engine causes a fluctuation of engine rotation, the valve overlap between exhaust and intake valves is assuredly kept, and thus, reduction of exhaust emission in the time that follows the engine starting is assuredly carried out.

Due to function of coil springs 31 and 31, the respective vane members 3 and 3 of exhaust and intake side phase varying mechanisms (viz., exhaust-VTC, intake-VTC) 1 and 2 are biased toward the most retarded timing side. Accordingly, in case of engine starting, a suitable valve overlap is assuredly provided. That is, reduction in exhaust emission in a certain time that follows the cold engine starting is assuredly carried out.

In the following, the second embodiment 200 of the present invention will be described with reference to FIGS. 10 to 17.

Figure 10:
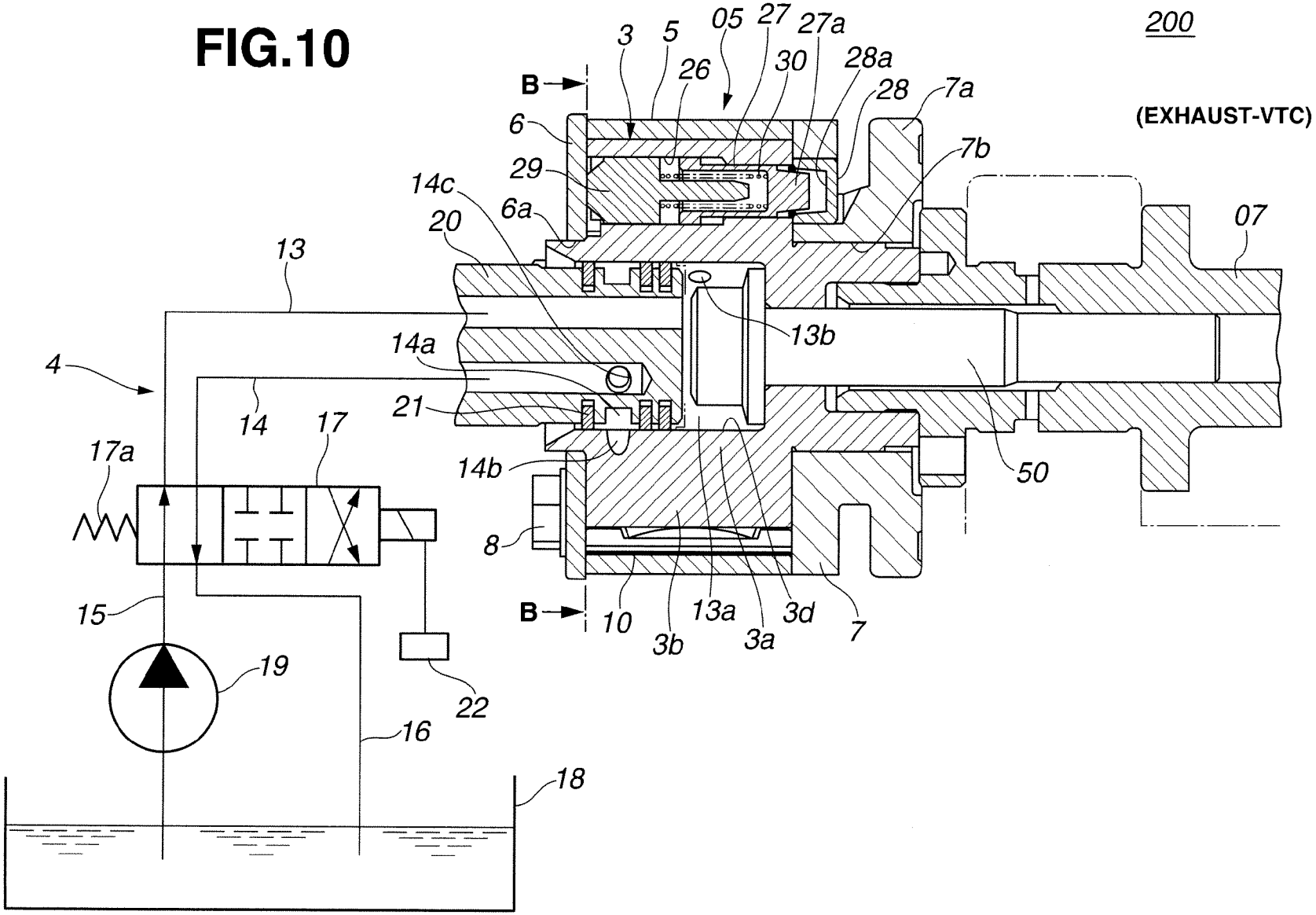
FIG. 10 is a sectional view of an exhaust side phase varying mechanism employed in a variable valve system of a second embodiment of the present invention.

As is seen from FIG. 10, the second embodiment 200 is substantially the same as the above-mentioned first embodiment 100 except for the arrangement of each electromagnetic switch valve 17 and the positioning of coil springs 31.

Figure 11:
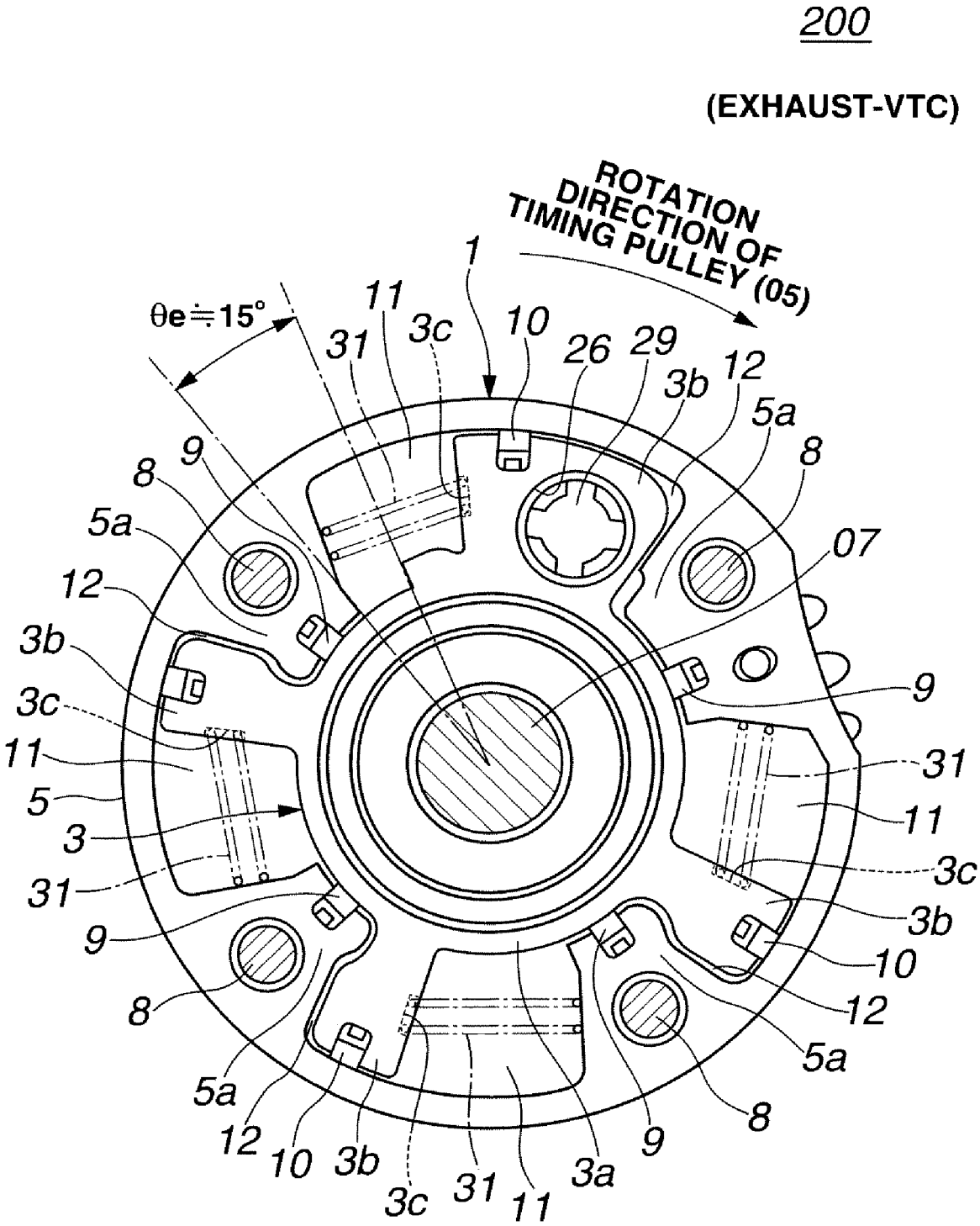
FIG. 11 is a sectional view taken along the line B-B of FIG. 10, showing the most-advanced timing position of the exhaust side phase varying mechanism employed in the variable valve system of the second embodiment.

As is seen from FIG. 11, the paired coil springs 31 are installed in each advancing hydraulic chamber 11. That is, coil springs 31 are arranged to bias vane member 3 in a timing advancing direction.

Also in this second embodiment 200, there are employed both exhaust side phase varying mechanism (exhaust-VTC) 1 and intake side phase varying mechanism (intake-VTC) 2. By these two mechanisms 1 and 2, the open/close timing of the exhaust and intake valves of the engine is controlled to stably take an advanced side upon engine stopping.

Figure 12:
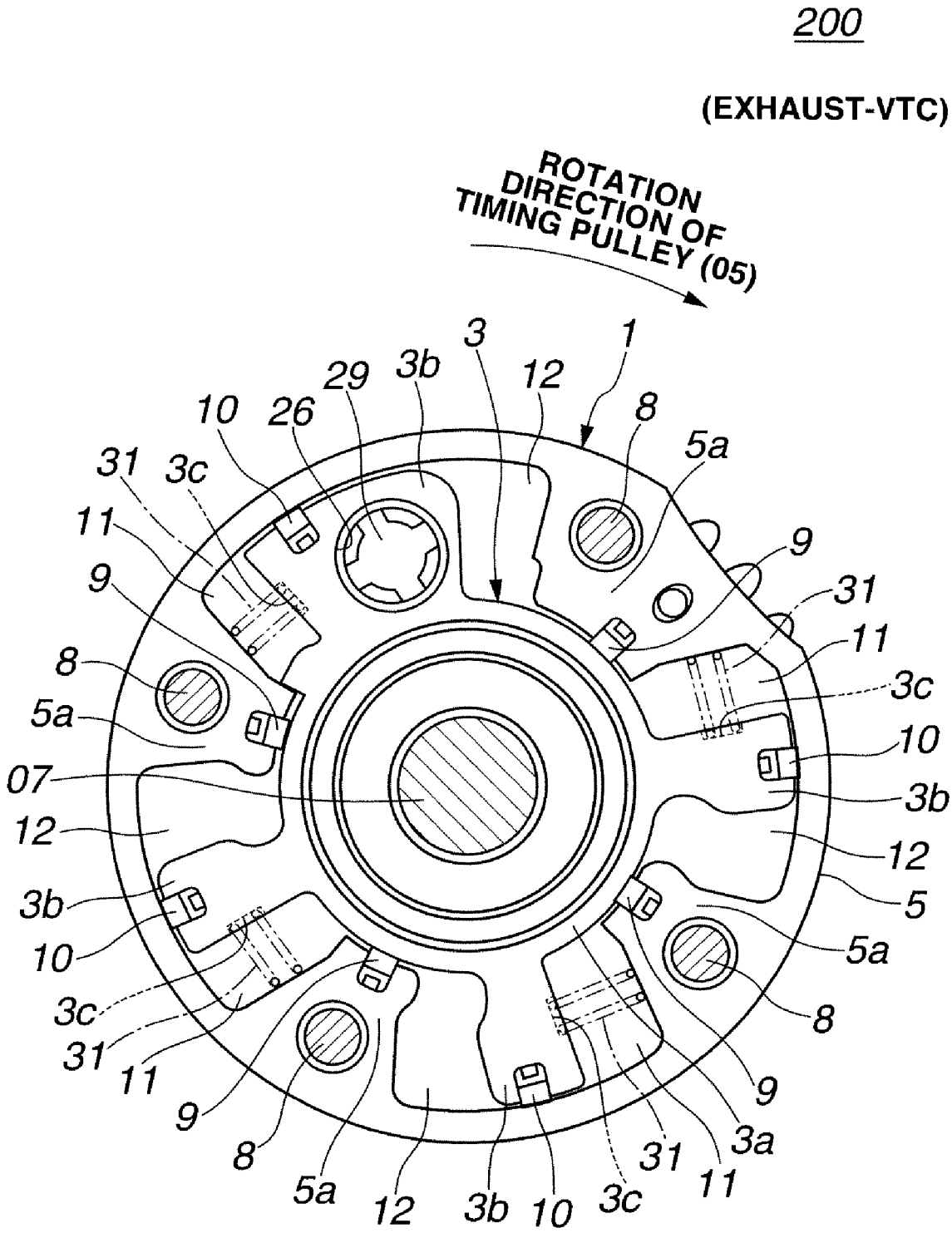
FIG. 12 is a view similar to FIG. 11, but showing the most retarded timing position of the exhaust side phase varying mechanism.
Figure 13:
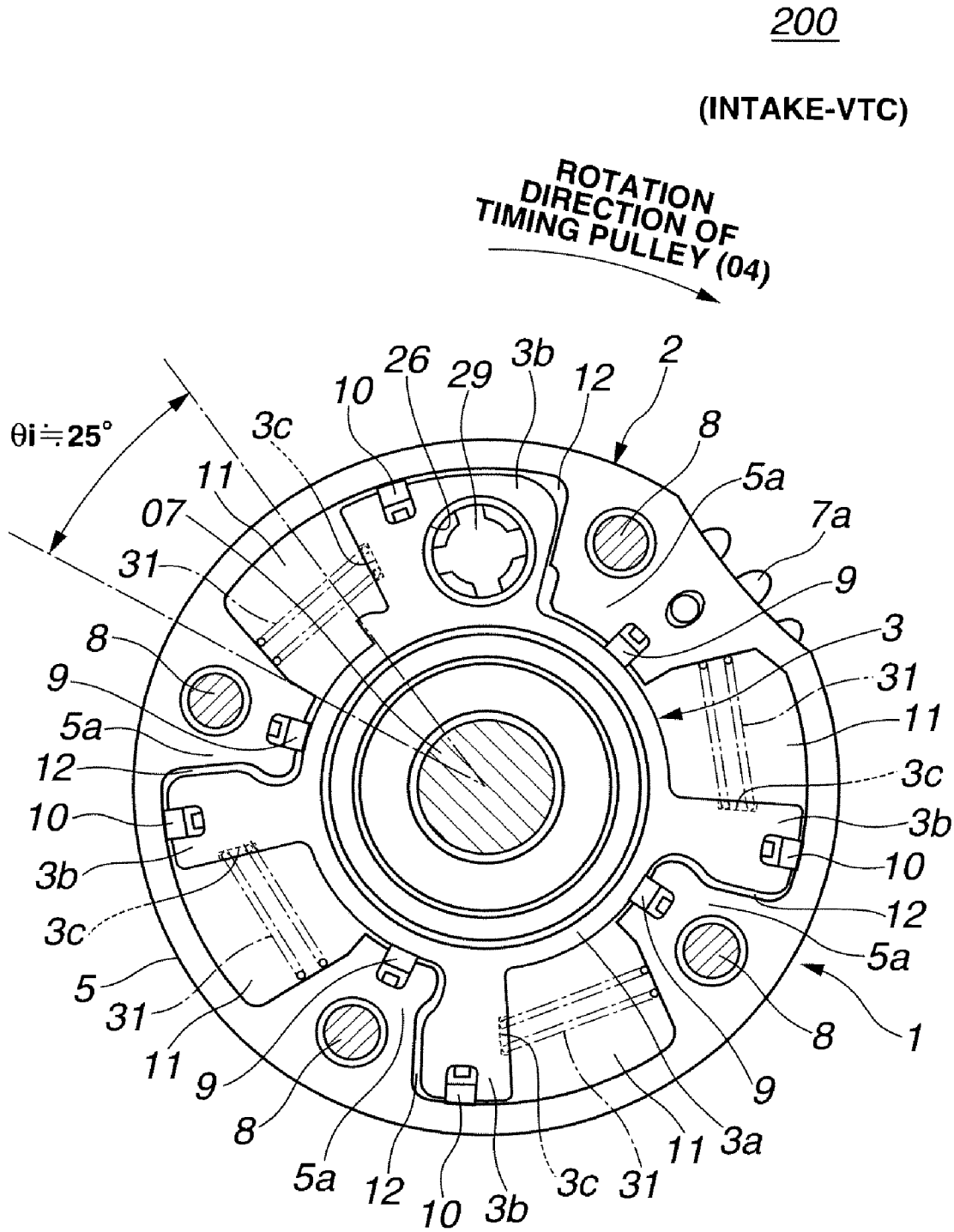
FIG. 13 is a sectional view of an intake side phase varying mechanism employed in the variable valve system of the second embodiment of the present invention.
Figure 14:
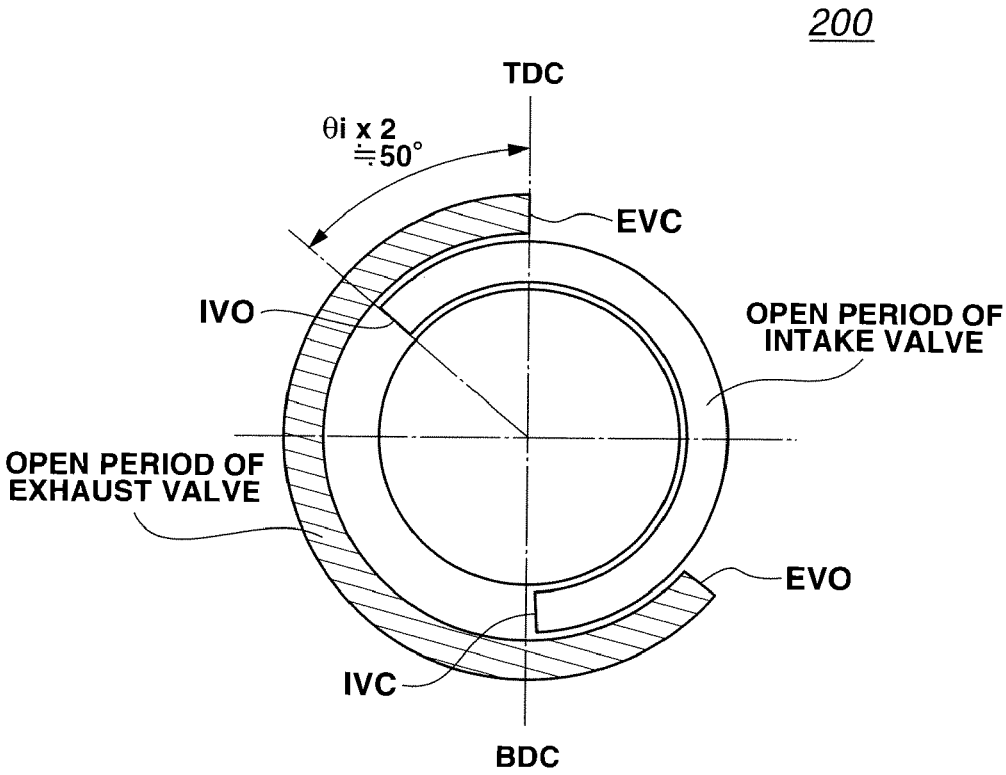
FIG. 14 is a characteristic diagram of the second embodiment, showing respective open periods of intake and exhaust valves at a time when the internal combustion engine stops or just starts.

FIGS. 10, 11 and 12 are drawings showing exhaust side phase varying mechanism (exhaust-VTC) 1. While, FIG. 13 is a drawing showing intake side phase varying mechanism (intake-VTC) 2. Like in the above-mentioned first embodiment 100, the construction of exhaust side phase varying mechanism (exhaust-VTC) 1 is substantially the same as that of intake side phase varying mechanism (intake-VTC) 2 also in this second embodiment 200.

In the following, operation of the second embodiment 200 will be described with the aid of the accompanying drawings, particularly FIG. 10.

For ease of understanding, the description will be commenced with respect to a condition wherein the vehicle is under idling condition. Under such condition, vane members 3 of the two mechanisms 1 and 2 assume each a position other than the most retarded and advanced timing positions, and electromagnetic switch valve 17 assumes a condition wherein feeding passage 15 is communicated with second hydraulic passage 14 and drain passage 16 is communicated with first hydraulic passage 13.

When now an ignition key is turned off, control current from control unit 22 to switch valve 17 stops. Upon this, with the force of biasing spring 17*a*, the valve element of the switch valve 17 is moved to the position as shown in FIG. 10. Thus, feeding passage 15 becomes communicated with first hydraulic passage 13 and drain passage 16 becomes communicated with second hydraulic passage 14. However, due to stopping of the engine, the hydraulic pressure produced by oil pump 19 becomes 0 (zero), and thus, the hydraulic pressure supplied to the four advancing hydraulic chambers 11 of each mechanism 1 or 2 through first hydraulic passage 13 is 0 (zero), which fails to produce a force to turn each vane member 3 in the timing advancing direction.

However, as will be understood from FIG. 11, even in such condition, due to force of coil springs 31, respective vane members 3 are forced to turn in the timing advancing direction.

More specifically, as is seen from FIGS. 11 and 13, by four pairs of coil springs 31 respectively installed in advancing hydraulic chambers 11, respective vane members 3 of exhaust and intake side phase varying mechanisms (exhaust-VTC and intake-VTC) 1 and 2 are biased to turn in an advancing direction.

These coil springs 31 have each a spring load that is higher than that of coil springs 31 employed in the above-mentioned first embodiment 100. This is because the coil springs 31 of the second embodiment 200 have to bias the vane member 3 in the advancing direction against the above-mentioned friction of valve mechanism.

As is seen from FIG. 13, the variable angle "Θi" of vane member 3 provided by intake side phase varying mechanism (intake-VTC) 2 is controlled to about 25 degrees, which is larger than the variable angle "Θe" (about 15 degrees, see FIG. 11) of vane member 3 provided by exhaust side phase varying mechanism (exhaust-VTC) 1. Accordingly, when the engine is at standstill or is started to operate, the valve overlap between the intake and exhaust valves shows about 50 degrees as is seen from FIG. 14, which is larger than 30 degrees in case of the first embodiment 100.

Accordingly, under this engine operation, the amount of residual gas in each combustion chamber is increased. However, if the engine is of a fuel direct injection type wherein fuel is directly fed into a combustion chamber, a high compression ratio induced by a cooling effect by the direct fuel injection brings about a stable combustion of fuel at a cold starting of the engine. Due to the same reason, the upper limit of effective valve overlap can increase. That is, reduction in exhaust emission at the cold engine starting is effectively carried out. Actually, in the fuel direct injection type engine, fuel supply to the combustion chamber is possible even when the intake valves are closed, which means increased flexibility of fuel injection pattern and thus increases possibility of improving fuel combustion.

When the engine is shifted to a normal idling state after completion of the warming-up operation, switching of switch valve 17 of intake side phase varying mechanism (intake-VTC) 2 is so made that first hydraulic passage 13 is connected with drain passage 16 and at the same time feeding passage 15 is connected with second hydraulic passage 14. Thus, retarding hydraulic chambers 12 of the mechanism (intake-VTC) 2 are fed with a pressurized hydraulic fluid, so that as will be easily imaged from FIG. 12, vane member 3 is turned counterclockwise against coil springs 31, that is, in a direction opposite to the rotation direction of timing pulley 04 (see FIG. 1) thereby to control the open/close timing of the intake valves to the most retarded timing position. While, in exhaust side phase varying mechanism (exhaust-VTC) 1, the control established at the engine starting is kept unchanged, and thus, the open/close timing of the exhaust valves is kept controlled to the most advanced timing side.

Figure 15:
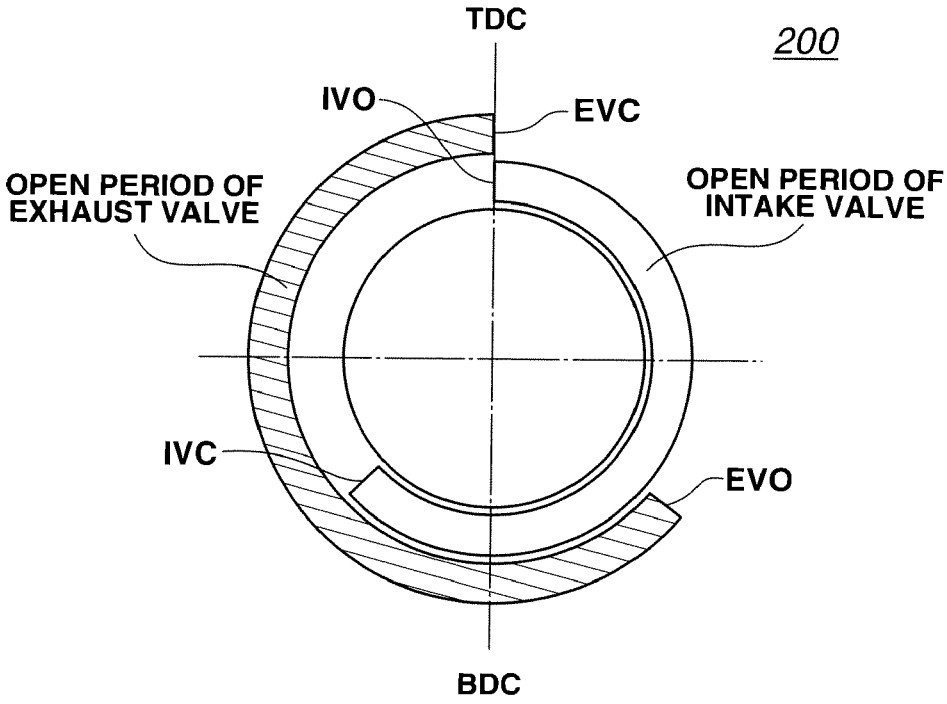
FIG. 15 is a characteristic diagram of the second embodiment, showing respective open periods of the intake and exhaust valves at a time when the engine runs at idle after completion of warming-up operation.

Accordingly, as is seen from FIG. 15, the close timing (viz., EVC) of the exhaust valves is controlled to or near the top dead center (viz., TDC), and the open timing (viz., IVO) of the intake valves is controlled to or near the top dead center (viz., TDC). That is, there is no overlap between the intake and exhaust valves in such case.

Figure 16:
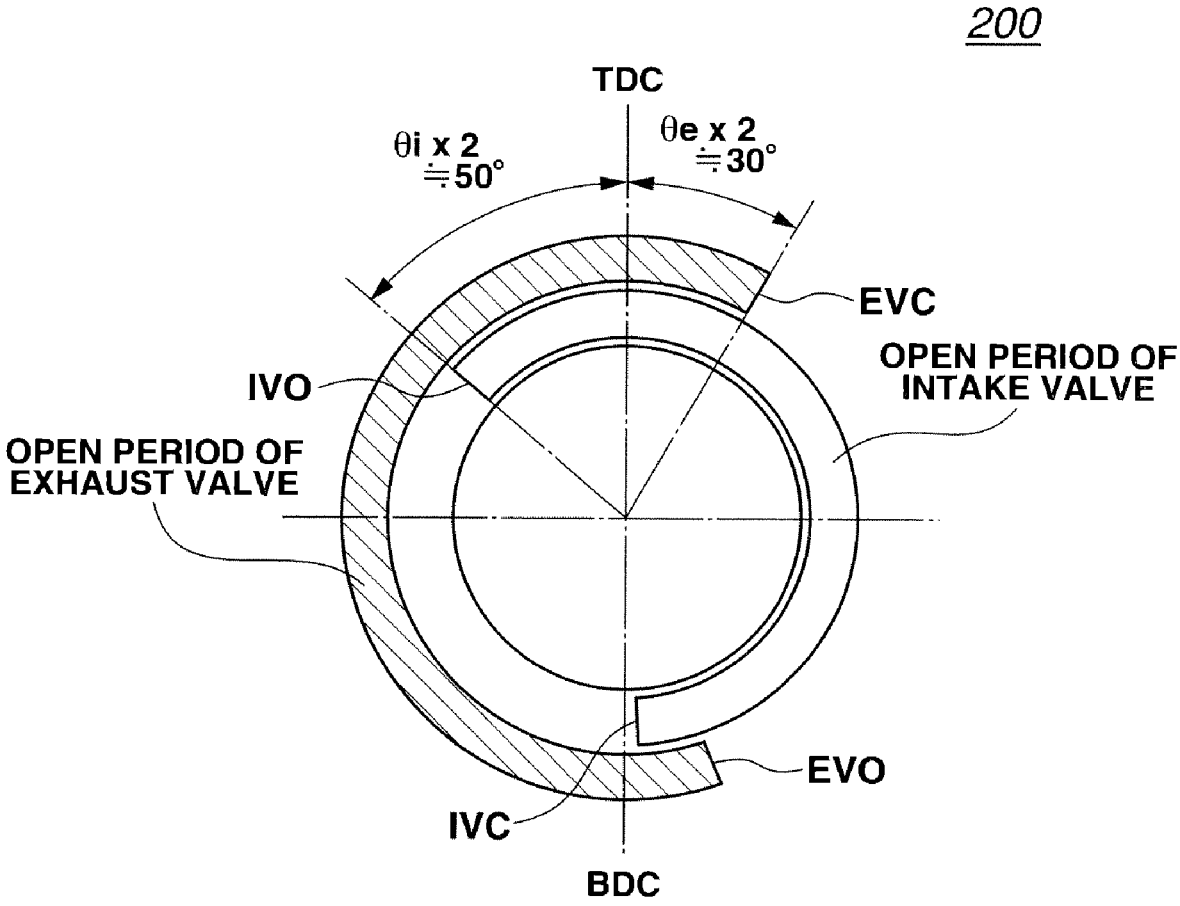
FIG. 16 is a characteristic diagram of the second embodiment, showing respective open periods of the intake and exhaust valves at a time when the engine is under intermediate load.

When the engine operation is shifted to an intermediate load range or low speed high load range, exhaust side phase varying mechanism (exhaust-VTC) 1 operates to control the open/close timing of the exhaust valves to the most retarded timing side as is understood from FIG. 16, and at the same time intake side phase varying mechanism (intake-VTC) 2 operates to control the open/close timing of the intake valves to the most advanced timing side as is understood from FIG. 16. Accordingly, as is seen from the drawing, the close timing (viz., EVC) of the exhaust valves is controlled to a timing that is retarded by about 30 degrees with respect to the top dead center (TDC), and at the same time the open timing (viz., IVO) of the intake valves is controlled to a timing that is advanced by about 50 degrees with respect to the top dead center (TDC). Thus, in such case, the valve overlap between the exhaust and intake valves shows about 80 degrees, as shown.

Figure 17:
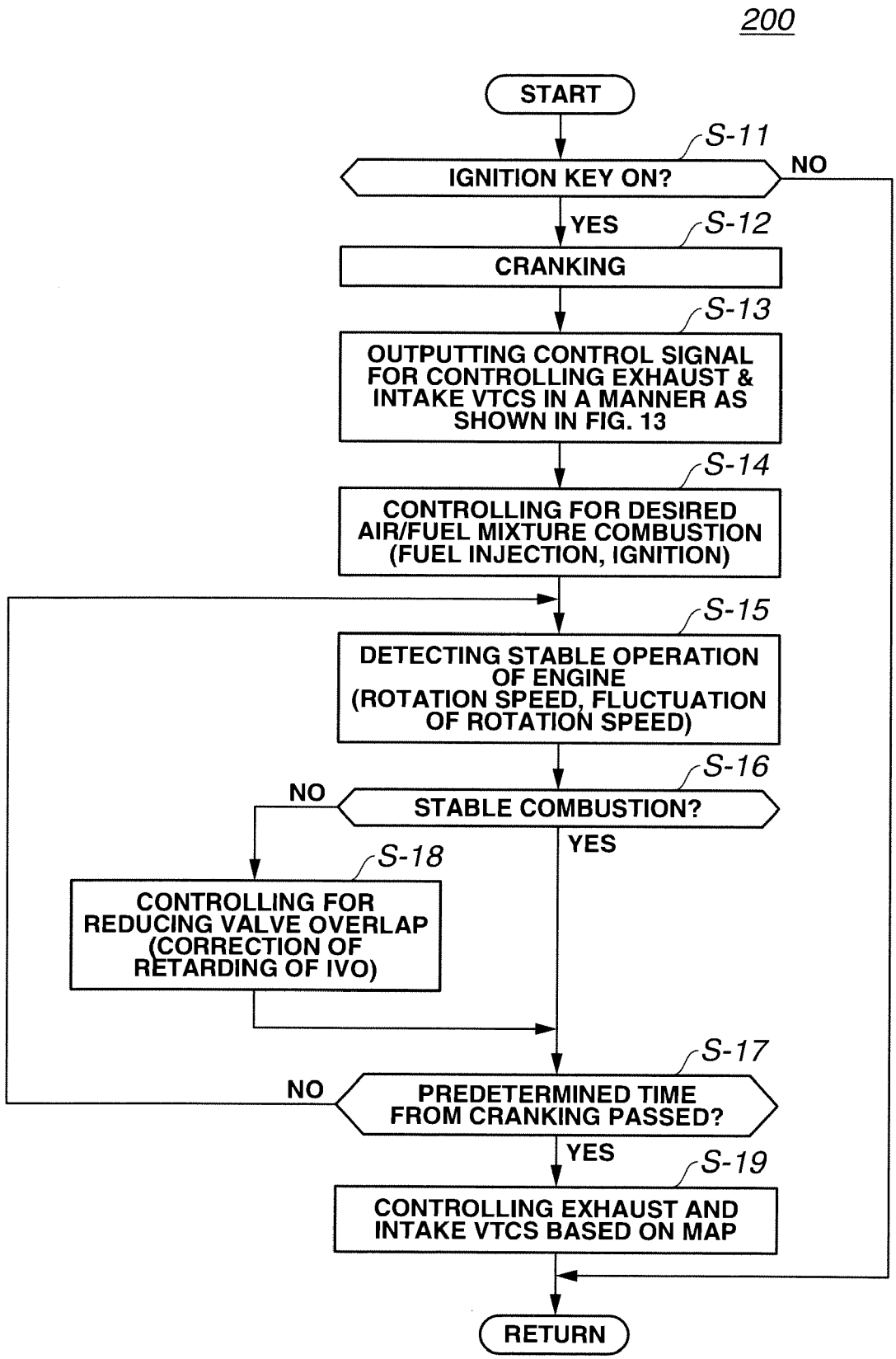
FIG. 17 is a flowchart showing programmed operation steps executed by a control unit employed in the variable valve system of the second embodiment of the present invention.

In the following, programmed operation steps executed by control unit 22 in case of the second embodiment 200 will be described with reference to the flowchart of FIG. 17.

Since the operation steps of the second embodiment 200 are similar to those of the above-mentioned first embodiment 100, only steps that are different from those of the first embodiment 100 will be described.

That is, in the second embodiment 200, at step S-13 which corresponds to step S-3, by exhaust and intake side phase varying mechanisms (exhaust-VTC and intake-VTC) 1 and 2, the open/close timing of both the exhaust and intake valves is controlled to the most advanced timing side, and when it is judged that the combustion is unstable at step S-15 which corresponds to S-5, the open timing (IVO) of the intake valves is controlled to the retarded timing side at step S-18 which corresponds to S-8, which reduces the degree of the valve overlap between the intake and exhaust valves.

Accordingly, also in this second embodiment 200, at a cold engine starting, a suitable valve overlap is kept provided between the intake and exhaust valves and thus reduction in exhaust emission in a certain period that follows the engine starting is assuredly made.

In the following, modifications of the invention will be briefly described.

In case of the first embodiment 100, coil springs 31 may be removed. That is, even when such springs 31 are not provided in the variable valve system, each vane member 3 is forced to turn toward the most retarded timing side due to the friction of valve mechanism in case when the engine stops. However, in case of the second embodiment 200, such coil springs 31 are essential because the turning of each vane member 3 toward the most advanced timing side has to be made against the friction of the valve mechanism.

The first and second embodiments 100 and 200 of the present invention are applicable to an internal combustion engine of a fuel direct injection type in which fuel is directly fed into a combustion chamber.

The internal combustion engine to which the first and second embodiments 100 and 200 of the invention are applicable may be of a type wherein two intake valves have different lifts.

The internal combustion engine to which the first and second embodiments 100 and 200 of the invention are applicable may be of a diesel type wherein ignition of combustible mixture is effected by heat of compression.

The entire contents of Japanese Patent Application 2007-243243 filed Sep. 20, 2007 are incorporated herein by reference.

Although the invention has been described above with reference to the embodiments of the invention, the invention is not limited to such embodiments as described above. Various modifications and variations of such embodiments may be carried out by those skilled in the art, in light of the above description.

What is claimed is:

1. A variable valve system of an internal combustion engine comprising:

an intake side phase varying mechanism configured to vary an open/close timing of an intake valve;

an exhaust side phase varying mechanism configured to vary an open/close timing of an exhaust valve, wherein, before starting the engine, one of the intake and exhaust side phase varying mechanisms is configured to keep a first position such that the intake and exhaust valves show a maximum valve overlap therebetween and the other of the intake and exhaust side phase varying mechanisms is configured to keep a second position such that the intake and exhaust valves show a minimum valve overlap therebetween; and a controller configured to cause, after starting the engine, the one of the intake and exhaust side phase varying mechanisms to be actually controlled to the first position and to cause the other of the intake and exhaust side phase varying mechanisms to be actually controlled to the second position.

2. A variable valve system as claimed in claim 1, wherein the one of the intake and exhaust side phase varying mechanisms is the exhaust side phase varying mechanism and the other of the intake and exhaust side phase varying mechanisms is the intake side phase varying mechanism.

3. A variable valve system as claimed in claim 1, wherein the one of the intake and exhaust side phase varying mechanisms is the intake side phase varying mechanism and the other of the intake and exhaust side phase varying mechanisms is the exhaust side phase varying mechanism.

4. A variable valve system as claimed in claim 1, wherein a maximum variable angle provided by the one of the intake and exhaust side phase varying mechanisms relative to a crank angle of the engine is set smaller than a maximum variable angle provided by the other of the intake and exhaust side phase varying mechanisms.

5. A variable valve system as claimed in claim 1, further comprising a lock mechanism that, before starting the engine, is configured to cause the first and second positions to be locked.

6. A variable valve system as claimed in claim 1, wherein the engine is of a direct fuel injection type such that fuel is directly fed into a combustion chamber.

7. A variable valve system as claimed in claim 1, wherein the one of the intake and exhaust side phase varying mechanisms comprises:

a housing rotatably driven by a crankshaft of the engine;

a vane member connected to an end of a cam shaft and rotatably received in the housing;

a rotation mechanism configured to cause a rotation of the vane member relative to the housing in accordance with an operation condition of the engine such that a phase of the cam shaft relative to the crankshaft is controlled; and a biasing member that biases the vane member in a direction to increase a degree of valve overlap between the intake and exhaust valves.

8. A variable valve system as claimed in claim 1, further comprising a corrective mechanism configured to, when the engine is subjected to an unstable rotation, control the one of the intake and exhaust side phase varying mechanisms in a manner to reduce a degree of valve overlap between the intake and exhaust valves.

9. A phase varying mechanism for varying an open/close timing of an exhaust valve of an internal combustion engine, comprising:

a device configured to cause the open/close timing of the exhaust valve to set a maximum retarded timing before starting the engine, wherein, when the open/close timing of the exhaust valve shows the maximum retarded timing, valve overlap between an intake valve and the exhaust valve shows a degree of overlap that is larger than a minimum valve overlap and smaller than a maximum valve overlap.

10. A phase varying mechanism as claimed in claim 9, wherein, when the open/close timing of the exhaust valve shows the maximum retarded timing, the valve overlap between the intake and exhaust valves is 30 degrees.

11. A phase varying mechanism as claimed in claim 9, wherein, when the engine is subjected to an unstable rotation after starting, the open/close timing of the exhaust valve is controlled to take an advancing side such that the degree of valve overlap between the intake and exhaust valves is reduced.

12. A phase varying mechanism as claimed in claim 11, wherein, when a predetermined time passes after the open/ close timing of the exhaust valve is controlled to take the advancing side, the open/close timing of the exhaust valve is shifted to a normal timing.

13. A phase varying mechanism as claimed in claim 12, wherein the predetermined time is varied in accordance with a temperature.

14. A method of controlling a variable valve system of an internal combustion engine, the variable valve system including an intake side phase varying mechanism that varies an open/close timing of an intake valve and an exhaust side phase varying mechanism that varies an open/close timing of an exhaust valve, the method comprising:

before starting the engine, causing one of the intake and exhaust side phase varying mechanisms to keep a first position such that the intake and exhaust valves show a maximum valve overlap therebetween and causing the other of the intake and exhaust side phase varying mechanisms to keep a second position such that the intake and exhaust valves show a minimum valve overlap therebetween; and after starting the engine, causing the one of the intake and exhaust side phase varying mechanisms to be actually controlled to the first position and causing the other of the intake and exhaust side phase varying mechanisms to be actually controlled to the second position.

* * * * *